US010312608B2

(12) United States Patent
Sabo

(10) Patent No.: US 10,312,608 B2
(45) Date of Patent: Jun. 4, 2019

(54) INSULATION DISPLACEMENT CONNECTOR

(71) Applicant: FCI USA LLC, Etters, PA (US)

(72) Inventor: James M. Sabo, Marysville, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/555,465

(22) PCT Filed: Feb. 24, 2016

(86) PCT No.: PCT/US2016/019283

§ 371 (c)(1),
(2) Date: Sep. 1, 2017

(87) PCT Pub. No.: WO2016/140844

PCT Pub. Date: Sep. 9, 2016

(65) Prior Publication Data

US 2018/0048082 A1 Feb. 15, 2018

Related U.S. Application Data

(60) Provisional application No. 62/127,415, filed on Mar. 3, 2015.

(51) Int. Cl.
*H01R 12/53* (2011.01)
*H01R 12/55* (2011.01)
(Continued)

(52) U.S. Cl.
CPC ..... *H01R 12/53* (2013.01); *H01R 4/2454* (2013.01); *H01R 4/2462* (2013.01); *H01R 12/55* (2013.01);
(Continued)

(58) Field of Classification Search
CPC ..... H01R 4/2445–4/2466; H01R 12/53; H01R 12/716; H01R 12/55; H01R 43/01; H01R 43/16
(Continued)

(56) References Cited

U.S. PATENT DOCUMENTS 3,845,455 A 10/1974 Shoemaker
3,936,128 A 2/1976 D'Annessa et al.
(Continued)

FOREIGN PATENT DOCUMENTS

CN 1094857 A 11/1994
CN 1290976 A 4/2001
(Continued)

OTHER PUBLICATIONS

Extended European Search Report for European Application No. 14831774.6 dated Jan. 31, 2017.
(Continued)

*Primary Examiner* — Gary F Paumen
(74) *Attorney, Agent, or Firm* — Wolf, Greenfield & Sacks, P.C.

(57) ABSTRACT

An insulation displacement contact includes a monolithic electrically conductive contact body that includes mating portion and a mounting portion. A plurality of the insulation displacement contacts are configured to be delivered to a substrate by a connector housing. The mating portion defines a pair of insulation displacement slots configured to receive an electrical cable so as to place the electrical cable in electrical communication with the substrate through the insulation displacement contact.

37 Claims, 8 Drawing Sheets

(51) Int. Cl.

| | |
|---|---|
| ***H01R 12/71*** | (2011.01) |
| ***H01R 43/01*** | (2006.01) |
| ***H01R 43/16*** | (2006.01) |
| ***H01R 4/2454*** | (2018.01) |
| ***H01R 4/2462*** | (2018.01) |

(52) U.S. Cl.
CPC ..... *H01R 12/716* (2013.01); *H01R 43/01* (2013.01); *H01R 43/16* (2013.01)

(58) Field of Classification Search
USPC ..... 439/397–403, 417
See application file for complete search history.

(56) References Cited

U.S. PATENT DOCUMENTS

| | | | | |
|---|---|---|---|---|
| 4,026,013 | A | 5/1977 | Hughes | |
| 4,039,239 | A | 8/1977 | Cobaugh et al. | |
| 4,192,570 | A | 3/1980 | Van Horn | |
| 4,220,390 | A | 9/1980 | Cobaugh et al. | |
| 4,261,629 | A | 4/1981 | Reynolds et al. | |
| 4,277,124 | A | 7/1981 | Loose et al. | |
| 4,363,529 | A | 12/1982 | Loose | |
| 4,381,880 | A * | 5/1983 | Pohl | H01R 4/2416 439/402 |
| 4,533,199 | A | 8/1985 | Feldberg | |
| 4,544,220 | A | 10/1985 | Aiello et al. | |
| 4,548,459 | A * | 10/1985 | Mosser, III | H01R 4/2462 439/395 |
| 4,575,173 | A | 3/1986 | Chapin et al. | |
| 4,648,676 | A | 3/1987 | Carrell | |
| 4,701,001 | A | 10/1987 | Verhoeven | |
| 4,716,651 | A | 1/1988 | Klaiber et al. | |
| 4,834,670 | A * | 5/1989 | Rodondi | H01R 4/2462 439/398 |
| 4,964,811 | A * | 10/1990 | Hayes, Sr. | H01R 4/48 439/398 |
| 4,995,825 | A | 2/1991 | Korsunsky et al. | |
| 5,022,868 | A | 6/1991 | Legrady | |
| 5,041,009 | A * | 8/1991 | McCleerey | H01R 12/675 439/405 |
| 5,122,081 | A | 6/1992 | Bogiel et al. | |
| 5,393,951 | A | 2/1995 | Kasper | |
| 5,551,889 | A | 9/1996 | Kozel et al. | |
| 5,554,047 | A * | 9/1996 | Englert, Jr. | H01R 12/675 439/404 |
| 5,562,478 | A * | 10/1996 | Yamamoto | H01R 4/2433 439/402 |
| 5,586,905 | A | 12/1996 | Marshall et al. | |
| 5,669,778 | A | 9/1997 | Kramer et al. | |
| 5,807,121 | A | 9/1998 | Fulop et al. | |
| 5,820,402 | A | 10/1998 | Chiacchio et al. | |
| 5,820,404 | A | 10/1998 | Chishima et al. | |
| 5,827,087 | A * | 10/1998 | Yamasaki | H01R 4/2425 439/395 |
| 5,960,540 | A | 10/1999 | Pentz | |
| 5,997,336 | A * | 12/1999 | Yamamoto | H01R 4/2425 439/397 |
| 6,074,238 | A | 6/2000 | DeRoss et al. | |
| 6,080,005 | A * | 6/2000 | Aoyama | H01R 4/2466 439/397 |
| 6,280,230 | B1 | 8/2001 | Takase et al. | |
| 6,325,659 | B1 | 12/2001 | Heinzen et al. | |
| 6,394,833 | B1 | 5/2002 | Bulmer et al. | |
| 6,443,752 | B1 | 9/2002 | Kosawa | |
| 6,554,633 | B1 | 4/2003 | Nobuyuki et al. | |
| 6,573,450 | B2 | 6/2003 | Saito et al. | |
| 6,979,222 | B2 | 12/2005 | Comini | |
| D516,521 | S | 3/2006 | Yao et al. | |
| 7,011,543 | B2 | 3/2006 | Hiramoto et al. | |
| 7,033,233 | B2 | 4/2006 | Fujimoto et al. | |
| 7,059,889 | B1 | 6/2006 | Pavlovic et al. | |
| 7,059,892 | B1 | 6/2006 | Trout | |
| 7,070,442 | B2 * | 7/2006 | Yamanashi | H01R 4/2433 439/404 |
| 7,134,903 | B1 | 11/2006 | Pavlovic | |
| 7,137,848 | B1 | 11/2006 | Trout et al. | |
| 7,160,156 | B2 | 1/2007 | Holliday | |
| D555,092 | S | 11/2007 | Li et al. | |
| D569,801 | S | 5/2008 | Chuang | |
| D569,802 | S | 5/2008 | Long et al. | |
| D645,827 | S | 9/2011 | Lee et al. | |
| 8,109,783 | B2 | 2/2012 | Bishop et al. | |
| 8,323,049 | B2 | 12/2012 | Ngo | |
| 8,403,707 | B2 | 3/2013 | Tai | |
| D688,246 | S | 8/2013 | Lee | |
| 8,714,996 | B2 * | 5/2014 | Bishop | H01R 4/2433 439/397 |
| 8,740,638 | B2 | 6/2014 | Lappoehn | |
| 8,794,991 | B2 | 8/2014 | Ngo | |
| 9,136,652 | B2 | 9/2015 | Ngo | |
| 9,289,848 | B2 | 3/2016 | Handel et al. | |
| 9,543,664 | B2 | 1/2017 | Sabo | |
| 9,543,665 | B2 | 1/2017 | Sabo | |
| 2002/0072269 | A1 | 6/2002 | Mitsugi | |
| 2002/0192997 | A1 | 12/2002 | Turek et al. | |
| 2003/0054684 | A1 * | 3/2003 | Yamanashi | H01R 4/2466 439/397 |
| 2003/0171023 | A1 | 9/2003 | Turek et al. | |
| 2004/0185703 | A1 | 9/2004 | Lee | |
| 2005/0191883 | A1 | 9/2005 | Woodward | |
| 2007/0082539 | A1 | 4/2007 | Pavlovic | |
| 2007/0254521 | A1 | 11/2007 | D'Agostini et al. | |
| 2008/0286991 | A1 | 11/2008 | Northey | |
| 2010/0068916 | A1 | 3/2010 | Chen | |
| 2010/0203752 | A1 | 8/2010 | Urano | |
| 2010/0210151 | A1 | 8/2010 | Niles et al. | |
| 2011/0059632 | A1 | 3/2011 | Bishop | |
| 2011/0217866 | A1 | 9/2011 | Roosdorp et al. | |
| 2012/0003850 | A1 | 1/2012 | Bishop et al. | |
| 2012/0052733 | A1 | 3/2012 | Zhu | |
| 2012/0149233 | A1 | 6/2012 | Hsueh | |
| 2012/0171909 | A1 | 7/2012 | Harada | |
| 2012/0238127 | A1 | 9/2012 | Bishop | |
| 2013/0010500 | A1 | 1/2013 | Phadke | |
| 2013/0040483 | A1 | 2/2013 | Ngo et al. | |
| 2013/0040500 | A1 | 2/2013 | Ngo et al. | |
| 2013/0225013 | A1 | 8/2013 | Peng | |
| 2015/0038002 | A1 | 2/2015 | Sabo | |
| 2015/0038003 | A1 * | 2/2015 | Sabo | H01R 4/2433 439/401 |
| 2016/0072200 | A1 | 3/2016 | Sabo | |
| 2017/0170615 | A1 | 6/2017 | Ngo et al. | |
| 2018/0048082 | A1 * | 2/2018 | Sabo | H01R 4/2462 |

FOREIGN PATENT DOCUMENTS

| | | | |
|---|---|---|---|
| CN | 1348621 | A | 5/2002 |
| CN | 1365165 | A | 8/2002 |
| CN | 1589511 | A | 3/2005 |
| CN | 101527399 | A | 9/2009 |
| CN | 101641840 | A | 2/2010 |
| CN | 203166226 | U | 8/2013 |
| DE | 25 33 694 | A1 | 2/1977 |
| EP | 0352905 | A2 | 1/1990 |
| FR | 2852744 | A1 | 9/2004 |
| JP | 2001-266972 | A | 9/2001 |
| JP | 2011-034935 | A | 2/2011 |
| KR | 10-1987-0000780 | | 2/1987 |
| KR | 10-1987-0007613 | | 6/1995 |
| TW | 576572 | U | 2/2004 |
| WO | WO 2012/123811 | A2 | 9/2012 |
| WO | WO 2014/172414 | A1 | 10/2014 |

OTHER PUBLICATIONS

Extended European Search Report for European Application No. 14784685.1 dated Nov. 10, 2016.

International Search Report and Written Opinion for International Application No. PCT/US2014/068779 dated Feb. 27, 2015.

International Preliminary Report on Patentability for International Application No. PCT/US2014/068779 dated Jun. 16, 2016.

(56) References Cited

OTHER PUBLICATIONS

International Search Report and Written Opinion for International Application No. PCT/US2014/048781 dated Nov. 12, 2014.
International Search Report and Written Opinion for International Application No. PCT/US2014/034289 dated Aug. 29, 2014.
International Preliminary Report on Patentability for International Application No. PCT/US2014/034289 dated Oct. 29, 2015.
International Search Report and Written Opinion for International Application No. PCT/US2016/019283 dated Jun. 9, 2016.
Extended European Search Report for European Application No. 16759282.3 dated Oct. 29, 2018.
Chinese Office Action for Chinese Application No. 201680021547.7 dated Nov. 27, 2018.
Taiwanese Office Action for Taiwanese Application No. 103126084 dated Dec. 22, 2018.

* cited by examiner

INSULATION DISPLACEMENT CONNECTOR

RELATED APPLICATIONS

This application is the U.S. National Stage of and claims priority to and the benefit of International Patent Application Number PCT/US2016/019283, entitled "INSULATION DISPLACEMENT CONNECTOR" filed on Feb. 24, 2016, which claims priority under 35 U.S.C. § 119(e) to U.S. Provisional Application Ser. No. 62/127,415, entitled "INSULATION DISPLACEMENT CONNECTOR" filed on Mar. 3, 2015. The entire contents of these applications are incorporated herein by reference in their entirety.

BACKGROUND

Insulation displacement connectors (IDCs) are configured to electrically connect one or more electrical cables to a complementary electrical component, such as a printed circuit board. For instance, insulation displacement connectors include at least one insulation displacement contact having a mating portion configured to be mate with the complementary electrical component, and a cable piercing end that is configured to at least partially receive an electrical cable. Electrical cables typically include at least one electrically insulative layer and an electrical conductor that is disposed inside the electrically insulative layer. The insulation displacement contact of the insulation displacement connector is configured to pierce the outer layer of insulation of the electrical cable so as to make contact with the electrical conductor, thereby placing the electrical conductor in electrical communication with the complementary electrical component. Insulation displacement connectors can be desirable, as they allow for connection to an insulated cable without first stripping the electrical insulation from the conductor.

SUMMARY

In accordance with one embodiment, an insulation displacement contact is configured to receive an electrical cable. The insulation displacement slot can include a base that is configured to mounted onto a substrate so as to place the insulation displacement contact in electrical communication with the substrate. The insulation displacement contact can include at least one arm that extends out with respect to the base. The first art can include first and second opposed portions that face each other so as to define a first insulation displacement slot therebetween. Each of the first and second opposed portions is configured to move away from the other in response to insertion of the electrical cable in the first insulation displacement slot. The insulation displacement contact can further include at least one stop member spaced from the at least one arm. The at least one stop member can be configured to abut one of the first and second opposed portions when the first and second opposed portions move away from each other in response to insertion of the electrical cable in the first insulation displacement slot.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
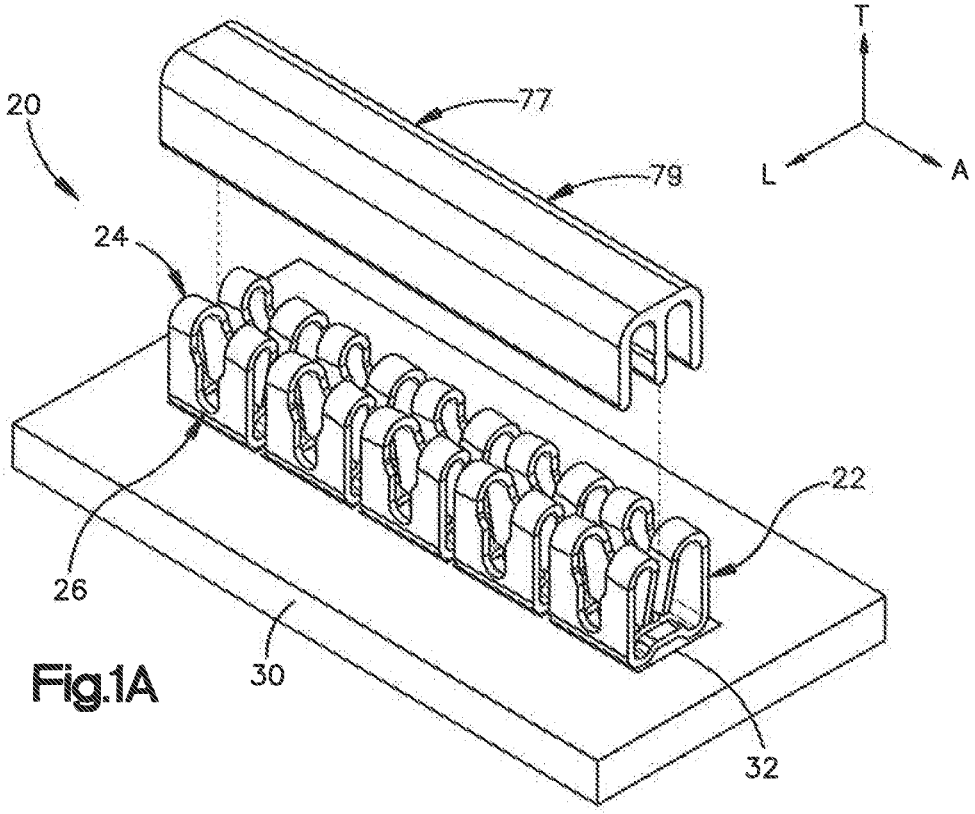
FIG. 1A is a perspective view of an electrical connector assembly, including a printed circuit board, a plurality of insulation displacement contacts mounted to the printed circuit board, and a connector housing that is configured to retain the insulation displacement contacts so as to deliver the insulation displacement contacts to the printed circuit board.
Figure 1B:
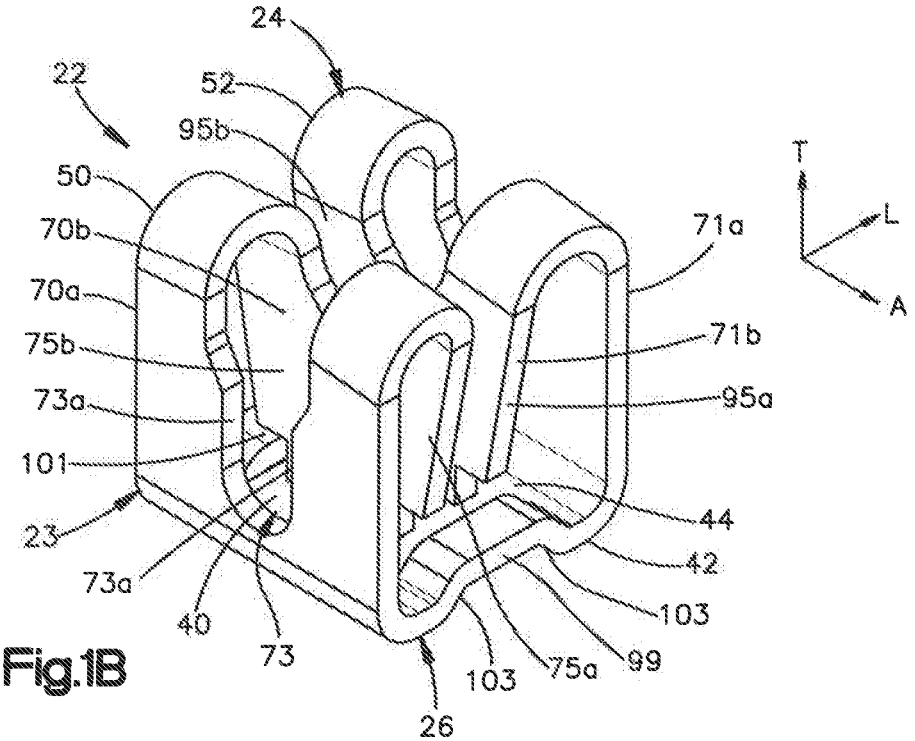
FIG. 1B is a perspective view of an insulation displacement contact as illustrated in FIG. 1A.
Figure 1C:
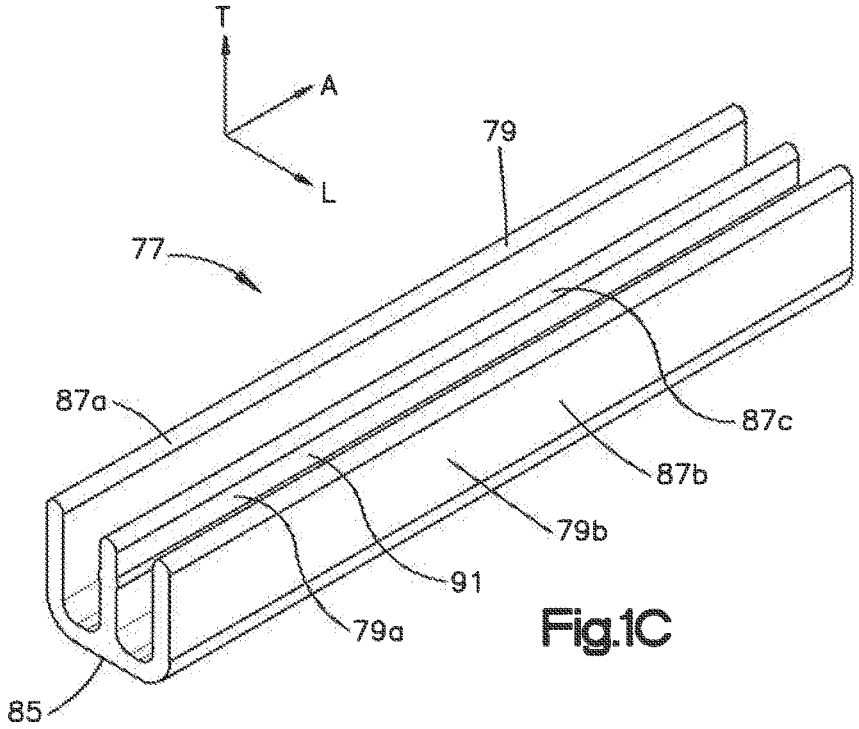
FIG. 1C is a perspective view of the connector housing illustrated in FIG. 1A.
Figure 1D:
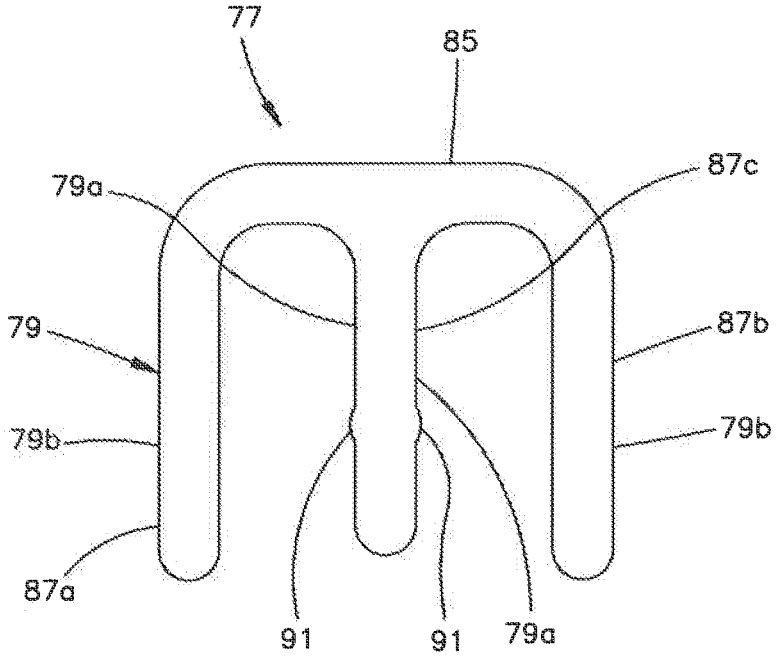
FIG. 1D is a side elevation view of the connector housing illustrated in FIG. 1C.
Figure 2A:
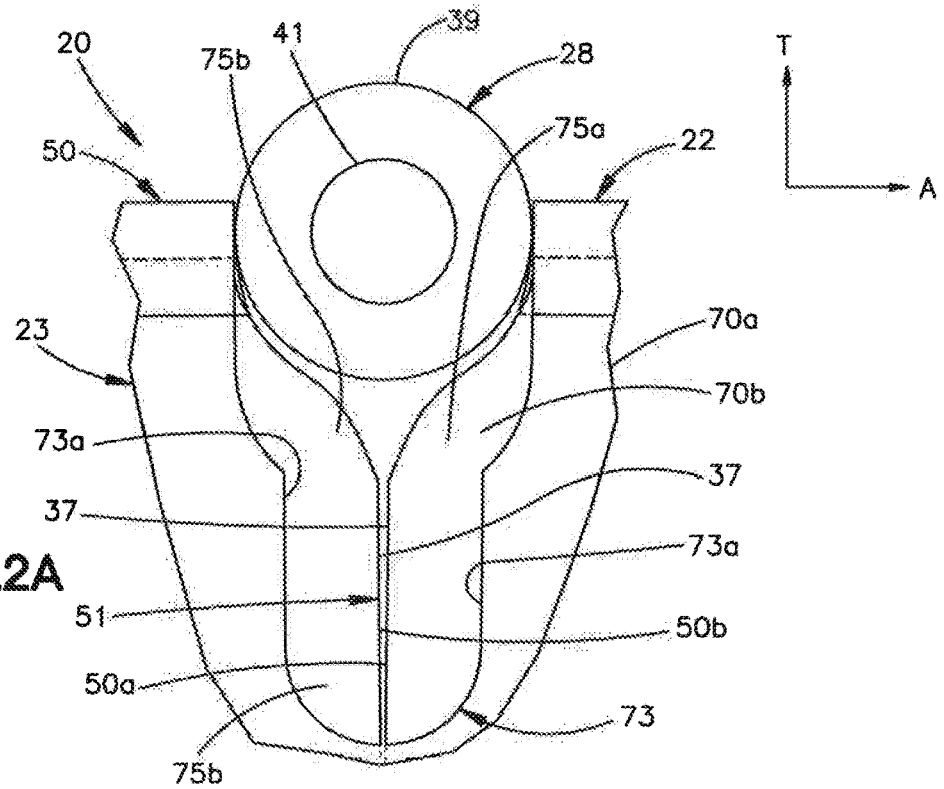
FIG. 2A is a schematic end elevation view of the insulation displacement contact illustrated in FIG. 1B, shown aligned to be mated with an electrical cable.
Figure 2B:
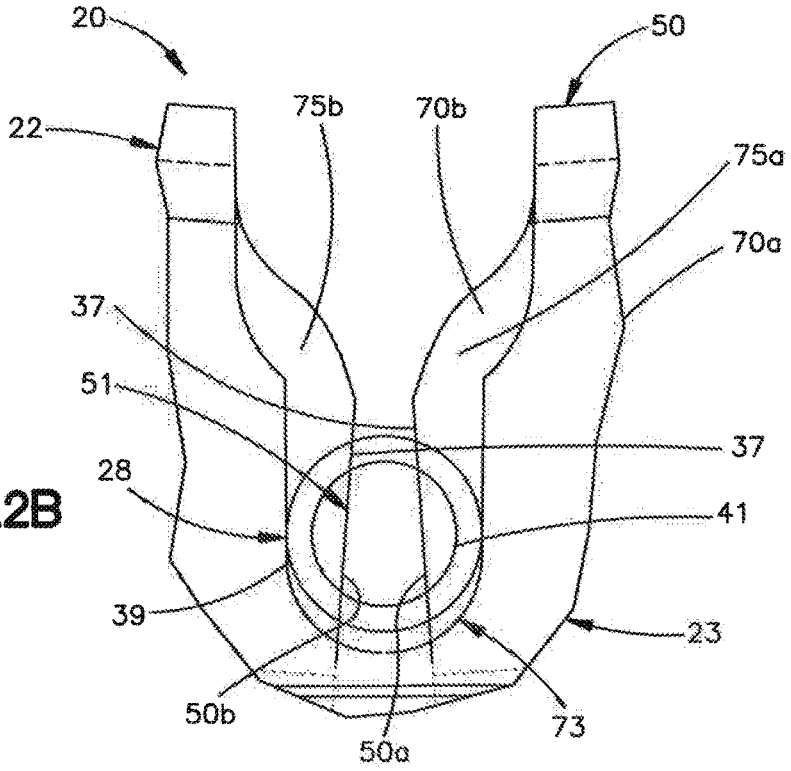
FIG. 2B is a schematic end elevation view of the insulation displacement contact illustrated in FIG. 2A, but shown mated with the electrical cable.
Figure 2C:
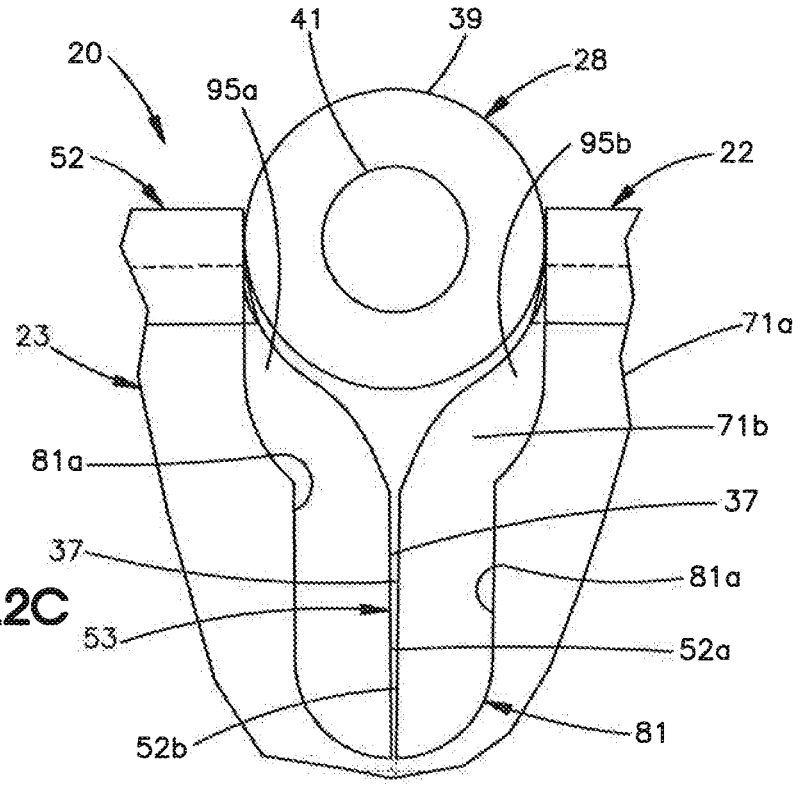
FIG. 2C is another schematic end elevation view of the insulation displacement contact illustrated in FIG. 1B, shown aligned to be mated with the electrical cable.
Figure 2D:
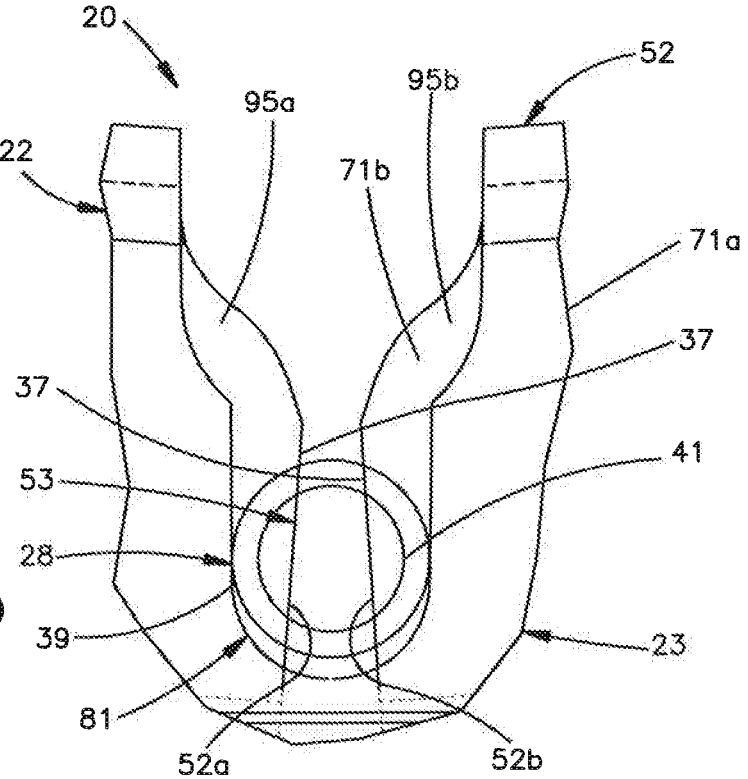
FIG. 2D is a schematic end elevation view of the insulation displacement contact illustrated in FIG. 2C, but shown mated with the electrical cable.

Referring now to FIGS. 1A-2B, an electrical connector assembly 20 can include at least one insulation displacement contact 22 such as a plurality of insulation displacement contacts 22 that define a mating portion 24 and a mounting portion 26. The electrical connector assembly 20 can further include at least one electrical cable 28 such as a plurality of electrical cables 28 that are configured to mate with a respective one of the insulation displacement contacts 22 at the mating portion 24, and a complementary electrical component 30 such as a substrate, tier instance a printed circuit board. The insulation displacement contacts 22, and in particular the mounting portions 26, are configured to be mounted to the substrate so as to place the insulation displacement contacts 22 in electrical communication with the substrate. The electrical connector assembly 20 can further include at least one dielectric or electrically insulative connector housing 77 configured to support at least one of the insulation displacement contacts 22, such as a plurality of the insulation displacement contacts 22. For instance, the connector housing 77 can be configured to retain a plurality of the insulation displacement contacts 22, and deliver the insulation displacement contacts 22 to the complementary electrical component 30.

The insulation displacement contacts 22, and in particular the respective mounting portions 26, are configured to be mounted to a respective electrical terminal 32 of the complementary electrical component 30, which for instance can be configured as a mounting pad. Thus, the mounting portions 26 are each configured to be surface mounted, for instance soldered, welded, or the like, onto the complementary electrical component 30, for instance to the electrical terminal 32. Alternatively, the mounting portion 26 can include at least one mounting tail as a projection that is configured to be inserted into an aperture of the complementary electrical component so as to mount the insulation displacement contact to the complementary electrical component 30. For instance, the mounting tail can be press-fit into the aperture of the complementary electrical component 30. The apertures can be electrically conductive plated vias, or can be apertures that are configured to receive the projections so as to locate the mounting portions 26 with the mounting pad. When the insulation displacement contact 22 is mounted to the complementary electrical component 30 and mated with the respective electrical cable 28, the electrical cable 28 is placed in electrical communication with the complementary electrical component 30. It should be appreciated that the complementary electrical component 30, and all complementary electrical components described herein, can be a printed circuit board or any suitable constructed alternative electrical component 30 as desired.

The insulation displacement contacts 22, and all insulation displacement contacts described herein, can be made from any suitable electrically conductive material, such as a metal. Each insulation displacement contact 22 can include an electrically conductive contact body 23 that defines both the mating portion 24 and the mounting portion 26, which can be monolithic with the mating portion 24. The mating portion 24 can include at least one slot that extends into the contact body 23, and at least one piercing member 37 that at least partially defines the slot such that, when the slot receives the electrical cable 28, the piercing member 37 pierces an outer electrically insulative layer 39 of the electrical cable 28 and contacts an electrical conductor 41 of the electrical cable 28 that is disposed inside the outer electrically insulative layer 39. For instance, the piercing member 37 can bite into the electrical conductor 41. The outer electrically insulative layer 39, and all outer electrically insulative layers as described herein, can be made of any suitable electrically insulative material as desired. The electrical conductor 41, and all electrical conductors as described herein, can be made from any suitable electrically conductive material as desired.

The electrically conductive contact body 23 can include a base 40 that defines an outer surface and an inner surface 44 that faces opposite the outer surface along a transverse direction T. In particular, the inner surface 44 can be said to be spaced above, or up from, the outer contact surface 42 along the transverse direction T, and the outer contact surface 42 is spaced below, or down from, the inner surface 44 along the transverse direction T. The outer surface is configured to face the electrical terminal, and can be configured as an outer contact surface 42 that is configured to contact the electrical terminal 32. For instance, the outer contact surface 42 can be surface mounted, such as soldered or welded, to the electrical terminal 32 in the manner described above. It should be appreciated that the mounting portion 26 can be defined by the base 40, and in particular the outer contact surface 42. When the outer contact surface 42 is in contact with the electrical terminal 32, either directly or indirectly, the electrical terminal 32 is placed in electrical communication with the mounting portion 26, and thus the mating portion 24.

The mating portion 24 can include a first arm 50 that extends from the mounting portion 26, and in particular from the base 40. The first arm 50 includes a first at least one surface 50*a* that defines a first insulation displacement slot 51 extending through the first arm 50, for instance along a longitudinal direction L that is perpendicular to the transverse direction T. The first at least one surface 50*a* can include a first pair of opposed surfaces 50*a* and 50*b* that are opposite each other along a lateral direction A that is perpendicular to both the longitudinal direction A and the transverse direction T. The at least one surface 50*a* can further define a piercing member 37 that pierces the outer electrically insulative layer 39 of the electrical cable 28 and contacts the electrical conductor 41 when the electrical cable 28 is disposed in the first insulation displacement slot 51. The mating portion 24 can further include a second arm 52 that also extends out with respect to the mounting portion 26, and in particular from the base 40. The first and second arms 50 and 52 can be spaced from each other along the longitudinal direction L. It should be appreciated that both the first arm 50 and the second arm 52 can extend directly out from the base 40, and thus directly from the mounting portion 26. The first and second arms 50 and 52 can be monolithic with the base 40, and thus can be monolithic with each other.

The first insulation displacement slot 51 can be referred to as a first insulation displacement slot, and the second arm 52 includes a second at least one surface 52*a* that defines a second insulation displacement slot 53 that extends through the second arm 52, for instance along the longitudinal direction L. The second at least one surface 52*a* can include a second pair of opposed surfaces 52*a* and 52*b* that are opposite each other along the lateral direction A. Thus, the contact body 23 includes first and second insulation displacement slots 51 and 53 that extend through the mating portion 24. The second at least one surface 52*a* can further define a piercing member 37 that pierces the outer electrically insulative layer 39 of the electrical cable 28 and contacts the electrical conductor 41 when the electrical cable 28 is disposed in the second insulation displacement slot 53. The first and second insulation displacement slots 51 and 53 are aligned with each other in the longitudinal direction L, such that the electrical cable 28 can be inserted into each of the first and second insulation displacement slots 51 and 53.

The first and second insulation displacement slots 51 and 53 can define any distance along the lateral direction A as desired. For instance, the first pair of opposed surfaces 50*a* and 50*b* that define the first insulation displacement slot 51 can abut each other prior to insertion of the electrical cable into the first insulation displacement slot 51. Alternatively, the first pair of opposed surfaces that define the first insulation displacement slot 51 can be spaced from each other any suitable distance along the lateral direction A greater than zero as desired prior to insertion of the electrical cable into the first insulation displacement slot 51. In one example, the distance is no greater than the cross-sectional dimension of the electrical conductor 41 of the electrical cable 28 in the lateral direction A. For instance, the distance can be less than the cross-sectional dimension of the electrical conductor 41 of the electrical cable 28 in the lateral direction A. It is appreciated that the cross-sectional dimension of the electrical conductor 41 of the electrical cable 28 in the lateral direction A can be circular, such that the cross-section is a diameter, or any alternative shape as desired. Accordingly, insertion of the electrical cable 28 into the first insulation displacement slot 51 causes the opposed surfaces 50*a* and 50*b* to move away from each other along the lateral direction A such that the electrical cable 28 is disposed in the first insulation displacement slot 51. In particular, the respective piercing members 37 of the opposed surfaces 50*a* and 50*b* can pierce through the outer electrically insulative layer 39 of the electrical cable so as to contact the electrical conductor 41. For instance, the piercing members 37 of the opposed surfaces 50*a* and 50*b* can bite into the electrical conductor. Further, the opposed surfaces 50*a* and 50*b* can torsionally move away from each other so that they extend along respective lines that converge along a direction away from the base 40. Thus, the orientations of the opposed surfaces 50*a* and 50*b* prevent the electrical cable 28 from moving up away from the base 40 and out of the first insulation displacement slot 51 during operation, for instance when the insulation displacement contact 22 is under vibration.

Similarly, the second pair of opposed surfaces 52*a* and 52*b* that define the second insulation displacement slot 53 can abut each other prior to insertion of the electrical cable 28 into the second insulation displacement slot 53. Alternatively, the second pair of opposed surfaces 52*a* and 52*b* that define the second insulation displacement slot 53 can be spaced from each other any suitable distance along the lateral direction A greater than zero as desired prior to insertion of the electrical 28 cable into the second insulation displacement slot 53. In one example, the distance is no greater than the cross-sectional dimension of the electrical conductor 41 of the electrical cable 28 in the lateral direction A. For instance, the distance can be less than the cross-sectional dimension of the electrical conductor 41 of the electrical cable 28 in the lateral direction A. It is appreciated that the cross-sectional dimension of the electrical conductor 41 of the electrical cable 28 in the lateral direction A can be circular, such that the cross-section is a diameter, or any alternative shape as desired. Accordingly, insertion of the electrical cable 28 into the second insulation displacement slot 53 causes the opposed surfaces 52*a* and 52*b* to move away from each other along the lateral direction A such that the electrical cable 28 is disposed in the second insulation displacement slot1 53. In particular, the respective piercing members 37 of the opposed surfaces 52*a* and 52*b* can pierce through the outer electrically insulative layer 39 of the electrical cable 28 so as to contact the electrical conductor 41. For instance, the piercing members 37 of the opposed surfaces 52*a* and 52*b* can bite into the electrical conductor 41. Further, the opposed surfaces 52*a* and 52*b* can torsionally move away from each other so that they extend along respective lines that converge toward each other along a direction away from the base 40. Thus, the orientations of the opposed surfaces 52*a* and 52*b* prevent the electrical cable 28 from moving up away from the base 40 and out of the second insulation displacement slot 53 during operation, for instance when the insulation displacement contact 22 is under vibration.

The first arm 50 can define a first or outer region 70*a* and a second or inner region 70*b*. The outer and inner regions 70*a* and 70*b* are located such that the inner region 70*b* is disposed between the outer region 70*a* and the second arm 52. In accordance with one embodiment, the outer region 70*a* can extend out from the base 40. The inner region 70*b* can extend from the outer region 70*a* toward the base 40 at a location spaced from the outer region 70*a* along the longitudinal direction L. Thus, the first arm 50 can define an inverted, or downward facing, concavity as it extends along the longitudinal direction L. The concavity can thus face the base 40. The concavity can be configured as a U-shape or any suitable alternative shape as desired. The concavity can be defined at an interface of the outer region 70*a* and the inner region 70*b*.

Similarly, the second arm 52 can define a first or outer region 71*a* and a second or inner region 71*b*. The outer and inner regions 71*a* and 71*b* are located such that the inner region 71*b* is disposed between the outer region 71*a* and the first arm 50 with respect to the longitudinal direction L. This, it should be appreciated that the inner regions 70*b* and 71*b* are disposed between the outer regions 70*a* and 71*a* with respect to the longitudinal direction L. The outer region 71*a* can extend out from the base 40. In accordance with one embodiment, the inner region 71*b* can extend from the outer region 71*a* toward the base 40 at a location spaced from the outer region 71*a* along the longitudinal direction L. Accordingly, the second arm 52 can define an inverted, or downward facing, concavity along the longitudinal direction L. The concavity can face the base 40. The concavity can be configured as a U-shape or any suitable alternative shape as desired. The concavity can be defined at an interface of the outer region 71*a* and the inner region 71*b*. It will be appreciated that the inner region 71*b* of the second arm 52 can be disposed between the inner region 70*b* of the first arm 50 and the outer region 71*a* of the second arm 52. Similarly, the inner region 70*b* of the first arm 50 can be disposed between the inner region 71*b* of the second arm 52 and the outer region 70*a* of the first arm 50. Thus, the first and second arms 50 and 52 of the insulation displacement contact 22 can combine to substantially define an M-shape. At least one or both of the inner regions 70*b* and 71*b* of the first and second arms 50 and 52 can be angled toward the respective outer regions 70*a* and 71*a* as it extends upward along the transverse direction T, that is away from the mounting portion 26, and in particular from the base 40.

It should be appreciated that the inner region 70*b* of the first arm 50 can define both of the opposed surfaces 50*a* and 50*b* that face each other so as to define the first insulation displacement slot 51. Thus, the first insulation displacement slot 51 can extend through the first arm 50 along the transverse direction T. For instance, the inner region 70*b* can include a first portion 75*a* and a second portion 75*b* that is disposed adjacent the first portion 75*a* along the lateral direction A. The first portion 75*a* can define the first surface 50*a*, and the second portion 75*b* can define the second surface 50*b* opposite the first surface 50*a*. The inner region 71*b* of the second arm 52 can define both of the opposed surfaces 52*a* and 52*b* that face each other so as to define the second insulation displacement slot 53. Thus, the second insulation displacement slot 53 can extend through the inner region 70*b* of the first arm 50 along the transverse direction T. For instance, the inner region 71*b* can include a first portion 95*a* and a second portion 95*b* that is disposed adjacent the first portion 95*a* along the lateral direction A. The first portion 95*a* can define the first surface 52*a*, and the second portion 95*b* can define the second surface 52*b* opposite the first surface 52*a*.

The insulation displacement contact 22 can further include at least one strain relief aperture, such as a first strain relief aperture 73, that extends through the mating portion 24. In particular, the first strain relief aperture 73 can extend through at least one of the first and second arms 50 and 52. In accordance with one embodiment, the first strain relief aperture 73 can extend through the first arm 50. For instance, the first strain relief aperture 73 can extend through the outer region 70*a* of the first arm 50. Thus, the outer region 70*a* of the first arm 50 can define opposed surfaces 73*a* that cooperate so as to define the first strain relief aperture 73. In particular, the opposed surfaces 73*a* can be opposite each other along the lateral direction A. The strain relief aperture 73 can extend down into the outer region 70*a* of the first arm toward the base 40, but can terminate in the outer region 70*a* without extending entirely through the outer region 70*a* in the transverse direction T. The first strain relief aperture 73 extends through the outer region 70*a* in the longitudinal direction L.

The opposed surfaces 73*a* can be configured to constrain the outer electrically insulative layer 39 when the electrical cable 28 extends through the first strain relief aperture 73. For instance, smaller gage cables may be sized such that the distance between the opposed surfaces 73*a* along the lateral direction A is greater than the outer diameter of the outer electrically insulating layer 39. Thus, the smaller gauge cable might not define an interference fit with the opposed surfaces 73*a*, but can nevertheless be constrained by the opposed surfaces 73*a* so as to be limited with respect to movement in the lateral direction A with respect to the insulation displacement contact 22. In one example, the opposed surfaces 73 can be spaced apart along the lateral direction A a distance less than the cross-sectional dimension of the outer electrically insulative layer 39 along the lateral direction A, but greater than the cross-sectional dimension of the electrically conductor 41 along the lateral direction A. Thus, the opposed surfaces 73*a* can be configured to grip the outer electrically insulative layer 39 without extending completely through the outer electrically insulative layer 39 to the electrical conductor 41 when the electrical cable 28 extends through the first strain relief aperture 73. In one example, the opposed surfaces 73*a* can cut into the outer electrically insulative layer 39 so as to grip the electrical cable 28 without contacting the electrical conductor 41.

The insulation displacement contact 22 can further include a second strain relief aperture 81 that extends through the mating portion 24. In particular, the second strain relief aperture 81 can extend through the other of the first and second arms 50 and 52 with respect to the first strain relief aperture 73. In accordance with one embodiment, the second strain relief aperture 81 can extend through the second arm 52. For instance, the second strain relief aperture 81 can extend through the outer region 71*a* of the second arm 52. Thus, the outer region 71*a* of the second arm 52 can define opposed surfaces 81*a* that cooperate so as to define the second strain relief aperture 81. In particular, the opposed surfaces 81*a* can be opposite each other along the lateral direction A. The second strain relief aperture 81 can extend down into the outer region 71*a* of the second arm 52 toward the base 40, but can terminate in the outer region 71*a* without extending entirely through the outer region 71*a*. The second strain relief aperture 81 extends through the outer region 71*a* in the longitudinal direction L.

The opposed surfaces 81*a* can be configured to constrain the outer electrically insulative layer 39 when the electrical cable 28 extends through the second strain relief aperture 81. For instance, smaller gage cables may be sized such that the distance between the opposed surfaces 81*a* along the lateral direction A is greater than the outer diameter of the outer electrically insulating layer 39. Thus, the smaller gauge cable might not define an interference fit with the opposed surfaces 81*a*, but can nevertheless be constrained by the opposed surfaces 81*a* so as to be limited with respect to movement in the lateral direction A with respect to the insulation displacement contact 22. In one example, the opposed surfaces 81*a* can be spaced apart along the lateral direction A a distance less than the cross-sectional dimension of the outer electrically insulative layer 39 along the lateral direction A, but greater than the cross-sectional dimension of the electrically conductor 41 along the lateral direction A. Thus, the opposed surfaces 81*a* can be configured to grip the outer electrically insulative layer 39 without extending completely through the outer electrically insulative layer 39 to the electrical conductor 41 when the electrical cable 28 extends through the second strain relief aperture 81. In one example, the opposed surfaces 81*a* can cut into the outer electrically insulative layer 39 so as to grip the electrical cable 28 without contacting the electrical conductor 41.

The first strain relief aperture 73 can be aligned with the first and second insulation displacement slots 51 and 53 along the longitudinal direction L. Further, the first strain relief aperture 73 is positioned such that one of the first and second insulation displacement slots 51 and 53 is positioned between the other of the insulation displacement slots 51 and 53 and the first strain relief aperture 73 with respect to the longitudinal direction L. In particular, the first insulation displacement slot 51 can be positioned between the second insulation displacement slot 53 and the first strain relief aperture 73. The first strain relief aperture 73 can be aligned with the first strain relief aperture 81 and the first and second insulation displacement slots 51 and 53 along the longitudinal direction L. The second strain relief aperture 81 is positioned such that the second insulation displacement slot 53 is disposed between the first insulation displacement slot 51 and the second strain relief aperture 81 with respect to the longitudinal direction L. Thus, each of the first and second insulation displacement slots 51 and 53 is positioned between the first and second strain relief apertures 73 and 81.

The outer region 70*a* can define a first outer lead-in to the first strain relief aperture 73 along the transverse direction T. The first outer lead-in is configured as an opening having a width along the lateral direction A that is greater than that of the first strain relief aperture 73. For instance, the width of the first outer lead-in in the lateral direction A can be greater than the cross-sectional dimension of the electrical cable 28 along the lateral direction A. The outer region 71*a* can define a second outer lead-in to the second strain relief aperture 81 along the transverse direction T. The second outer lead-in is configured as an opening having a width along the lateral direction A that is greater than that of the second strain relief aperture 81. For instance, the width of the second outer lead-in can be greater than the cross-sectional dimension of the electrical cable 28 along the lateral direction A. The width of the first outer lead-in can be equal to the width of the second outer lead-in along the lateral direction A.

The inner region 70*b* can define a first inner lead-in to the first insulation displacement slot 51 along the transverse direction T. The first inner lead-in is configured as an opening that extends through the inner region 70*b* along the longitudinal L direction, and defines a width along the lateral direction A that is greater than that of the first insulation displacement slot 51. For instance, the width of the first inner lead-in can be greater than the cross-sectional dimension of the electrical cable 28 along the lateral direction A. The inner region 71*b* can define a second inner lead-in to the second insulation displacement slot 53 along the transverse direction T. The second inner lead-in is configured as an opening having that extends through the inner region 71*b* along the longitudinal direction L, and defines a width along the lateral direction A that is greater than that of the second insulation displacement slot 53. For instance, the width of the second inner lead-in can be greater than the cross-sectional dimension of the electrical cable 28 along the lateral direction A. The width of the first inner lead-in can be equal to the width of the second inner lead-in along the lateral direction A.

During operation, the electrical cable 28 is inserted into the first and second insulation displacement slots 51 and 53 and the first and second strain relief apertures 73 and 81 in the downward direction toward the base 40 along the transverse direction T. For instance, the electrical cable 28 can be inserted into the first and second outer lead-ins and the first and second inner lead-ins along the transverse direction, and then into the first and second insulation displacement slots 51 and 53 and the first and second strain relief apertures 73 and 81. For example, the electrical cable 28 can be inserted into the first and second insulation displacement slots 51 and 53 substantially simultaneously with insertion into the first and second strain relief apertures 73 and 81. As the electrical cable 28 is inserted into the first and second strain relief apertures 73 and 81, the opposed surfaces 73*a* and 81*a* bite into the outer electrically insulative layer 39 so as to retain the outer electrically insulative layer 39 and prevent the outer electrically insulative layer 39 from moving along the longitudinal direction L in response to application of a tensile force to the outer electrically insulative layer 39 from a location outboard of the insulation displacement contact 22.

As the electrical cable 28 is inserted into the first insulation displacement slot 51, the electrical cable 28 contacts the opposed surfaces 50*a* and 50*b*, and applies a force the opposed surfaces 50*a* and 50*b* in the lateral direction A that biases the respective first and second portions 75*a* and 75*b* of the inner region 70*b* to move away from each other along the lateral direction A. For instance, the first and second portions 75*a* and 75*b* can flex away from each other in the lateral direction A. Similarly, as the electrical cable 28 is inserted into the second insulation displacement slot 53, the electrical cable 28 contacts the opposed surfaces 51*a* and 51*b*, and applies a force the opposed surfaces 51*a* and 51*b* in the lateral direction A that biases the respective first and second portions 95*a* and 95*b* of the inner region 71*b* to move away from each other along the lateral direction A. For instance, the first and second portions 95*a* and 95*b* can flex away from each other in the lateral direction A.

In order to ensure that the piercing members 37 of the opposed surfaces create and maintain reliable contact with the electrical conductor 41 of the electrical cable 28, the insulation displacement contact body 23, and thus the insulation displacement contact 22, can include one or more step members 99. The at least one stop member 99 is positioned outboard of a respective one of the first and second portions of the inner region along the lateral direction A. The at least one stop member 99 can extend from the base 40 in the transverse direction T. The at least one stop member 99 defines an abutment surface that is positioned to contact the respective one of the first and second portions. Accordingly, when the respective one of the first and second portions moves away from the other of the first and second portions in the lateral direction, the moved one of the first and second portions will abut the stop member 99. Thus, the stop member 99 will prevent further movement of the at least one of the first and second portions away from the other of the first and second portions along the lateral direction A. In particular, the stop member 99 is offset from the piercing member 37 of the other of the first and second surface portions a first distance in the lateral direction A. The first distance is no greater than a combined cross-sectional dimension of the electrical conductor 41 in the lateral direction A plus the distance between abutment surface of the stop member 99 and the piercing member 37 of the respective one of the first and second portions along the lateral direction A when the respective one of the first and second portions is in contact with the abutment surface of the stop member 99.

The at least one stop member 99 can include a first stop member 99 and a second stop member 101. The first stop member 99 can be positioned outboard of the first portion 75*a* along the lateral direction A, such that the first portion 75*a* is disposed between the second portion 75*b* and the first stop member 99 along the lateral direction A. Similarly, the first stop member 99 can be positioned outboard of the first portion 95*a* along the lateral direction A, such that the first portion 95*a* is disposed between the second portion 95*b* and the first stop member 99 along the lateral direction A. The second stop member 101 can be positioned outboard of the second portion 75*b* along the lateral direction A, such that the second portion 75*b* is disposed between the first portion 75*a* and the second stop member 101 along the lateral direction A. Similarly, the second stop member 101 can be positioned outboard of the second portion 95*b* along the lateral direction A, such that the second portion 95*b* is disposed between the first portion 95*a* and the second stop member 101 along the lateral direction A. Each of the first and second portions 75*a* and 75*b* can be disposed above the base 40 along the transverse direction T so that they are free to flex generally along the lateral direction A without abutting the inner surface 44. Similarly, each of the first and second portions 95*a* and 95*b* can be disposed above the base 40 along the transverse direction T so that they are free to flex generally along the lateral direction A without abutting the inner surface 44. The first and second stop members 99 and 101 can be aligned with the respective pairs of first and second portions 75*a* and 75*b* along the lateral direction A, such that a first line oriented in the lateral direction A passes through both the first and second stop members 99 and 101 and the first and second portions 75*a* and 75*b*. Similarly, the first and second stop members 99 and 101 can be aligned with the respective pairs of first and second portions 95*a* and 95*b* along the lateral direction A, such that a second line oriented in the lateral direction A passes through both the first and second stop members 99 and 101 and the first and second portions 95*a* and 95*b*. The first and second lines can be spaced above the inner surface 44 of the base 40.

In one example, the first and second stop members 99 and 101 can each extend up from the base 40. In one example, the first and second stop members 99 and 101 can each be monolithic with the base 40, and thus also monolithic with the first and second arms 50 and 52. Alternatively, the first and second stop members 99 and 101 can be attached to the base 40 in any suitable manner desired. For instance, the insulation displacement contact body 23, and thus the contact 22, can include a first pair of opposed stand off members 103 that are spaced from each other in any suitable direction as desired, and extend up from the base 40. For instance, in one example, the stand off members 103 can be spaced from each other substantially along the longitudinal direction L. The stand off members 103 can extend upward along the transverse direction T as they extend toward each other. The first stop member 99 can extend between the opposed standoff members 103. Thus, the first stop member 99 is attached to the base 40 at both ends. For instance, the first stop member 99 can be monolithically attached to the base 40 at both ends. The first stop member 99 can extend along a plane that is defined by the lateral direction A and the longitudinal direction L. Similarly, the base 40 can include a second pair of opposed standoff members 105 that are spaced from each other in any suitable direction as desired. For instance, in one example, the stand off members 105 can be spaced from each other substantially along the longitudinal direction L. The stand off members 105 can extend upward along the transverse direction T as they extend toward each other. The second stop member 101 can extend between the opposed stand off members 105. Thus, the second stop member 101 is attached to the base 40 at both ends. For instance, the second stop member 101 can be monolithically attached to the base 40 at both ends. The second stop member 101 can extend along a plane that is defined by the lateral direction A and the longitudinal direction L. The standoff members 103 and 105 can have a width in the lateral direction A as desired. For instance, the width of the stand off members 103 can be greater than the thickness of the stock material that defines the insulation displacement contact 22, as described in more detail below.

The first stop member 99 can define a first abutment surface that is configured to abut the first portion 75*a* of the inner region 70*b* and the first portion 95*a* of the inner region 71*b*. Similarly, the second stop member 101 can define a second abutment surface that is configured to abut the second portion 75*b* of the inner region 70*b* and the second portion 95*b* of the inner region 71*b*. The first and second abutment surfaces can be spaced from each other a distance along the lateral direction A such, when the first and second portions 75*a* and 75*b* abut the respective first and second abutment surfaces, the distance between the piercing members 37 of the first and second portions 75*a* and 75*b* along the lateral direction A is less than the cross-sectional dimension of the electrical conductor 41 along the lateral direction A. Accordingly, the piercing members 37 of the first and second portions 75*a* and 75*b* can maintain reliable contact with the electrical conductor 41 when the electrical cable 28 is disposed in the first insulation displacement slot 51. In one embodiment, the first and second stop members 99 and 101 can be substantially rigid, so as to prevent further movement of the first and second portions 75*a* and 75*b* away from each other along the lateral direction once the first and second portions 75*a* and 75*b* abut the first and second stop members 99 and 101, respectively. Similarly, when the first and second portions 95*a* and 95*b* abut the respective first and second abutment surfaces, the distance between the piercing members 37 of the first and second portions 95*a* and 95*b* along the lateral direction A is less than the cross-sectional dimension of the electrical conductor 41 along the lateral direction A. Accordingly, the piercing members 37 of the first and second portions 95*a* and 95*b* can maintain reliable contact with the electrical conductor 41 when the electrical cable 28 is disposed in the second insulation displacement slot 53. In one embodiment, the first and second stop members 99 and 101 can be substantially rigid, so as to prevent further movement of the first and second portions 95*a* and 95*b* away from each other along the lateral direction once the first and second portions 95*a* and 95*b* abut the first and second stop members 99 and 101, respectively. The first and second abutment surfaces can have a thickness in the transverse direction T that is equal to the thickness of the stock material that defines the insulation displacement contact 22, which will now be described.

Figure 3A:
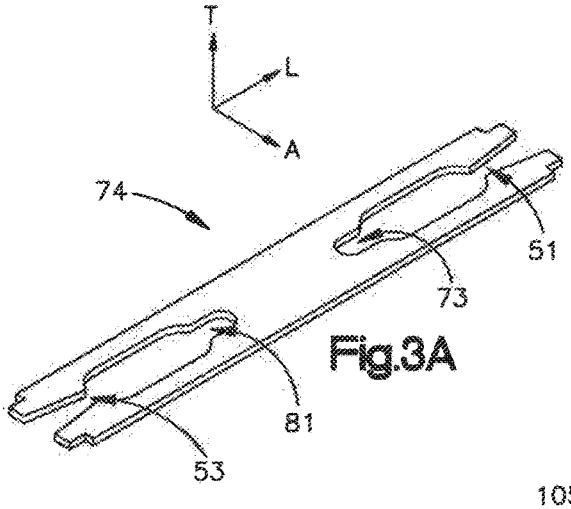
FIG. 3A is a perspective view of a blank of sheet metal configured to be bent so as to fabricate the insulation displacement contact illustrated in FIG. 1B.
Figure 3B:
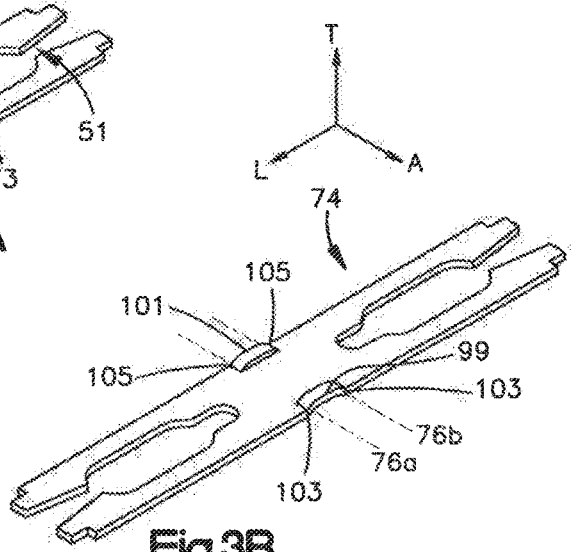
FIG. 3B is a perspective view of the sheet metal illustrated in FIG. 3A, but bent so as to produce certain structure of the insulation displacement contact illustrated in FIG. 1B.
Figure 3C:
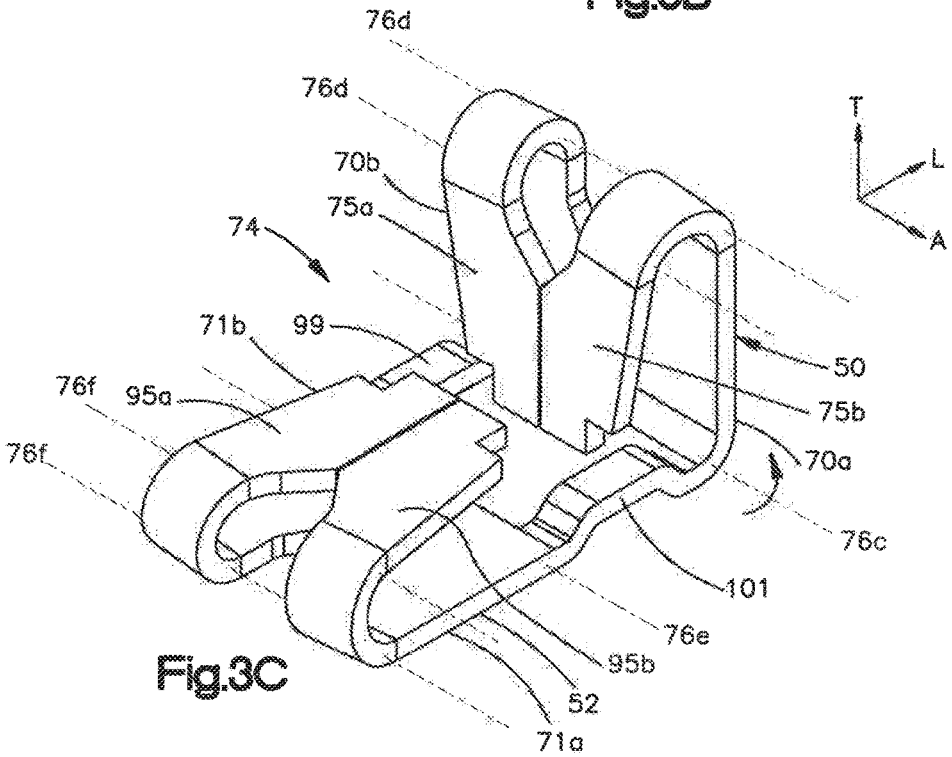
FIG. 3C is a perspective view of the sheet metal illustrated in FIG. 3B, but further bent so as to produce certain additional structure of the insulation displacement contact illustrated in FIG. 1B.
Figure 4A:
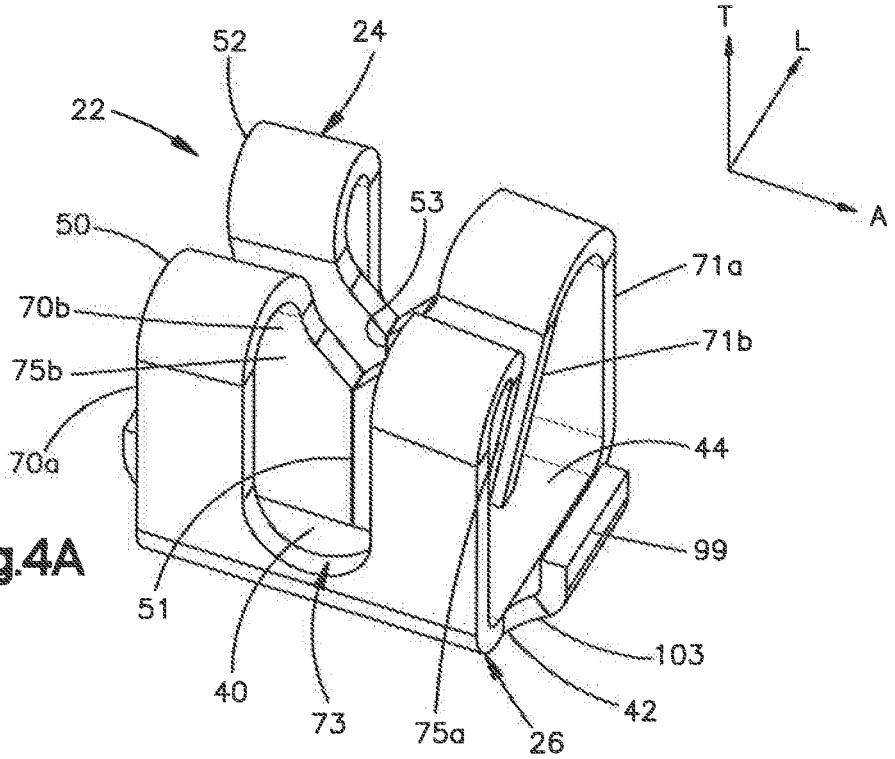
FIG. 4A is a perspective view of an insulation displacement contact constructed in accordance with an alternative embodiment.
Figure 4B:
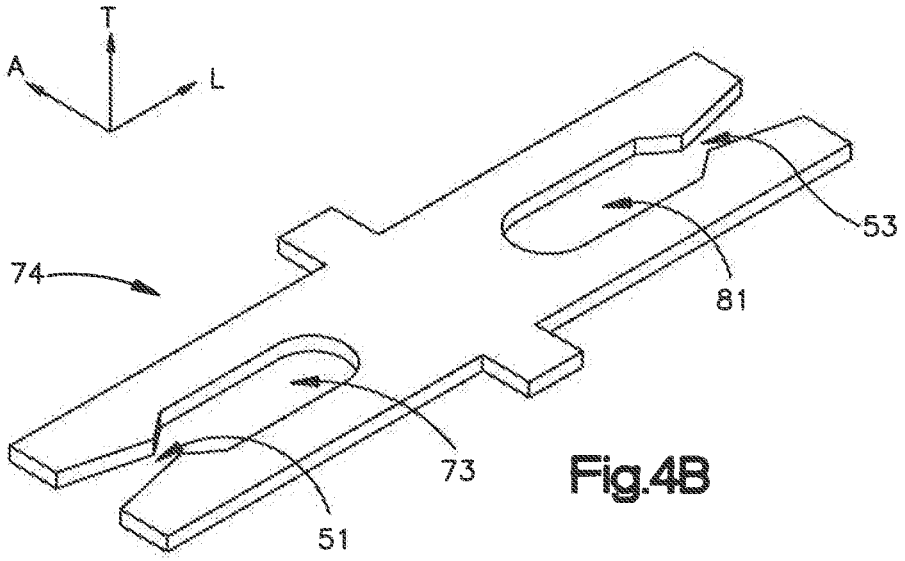
FIG. 4B is a perspective view of a blank of sheet metal configured to be bent so as to fabricate the insulation displacement contact illustrated in FIG. 4A.
Figure 4C:
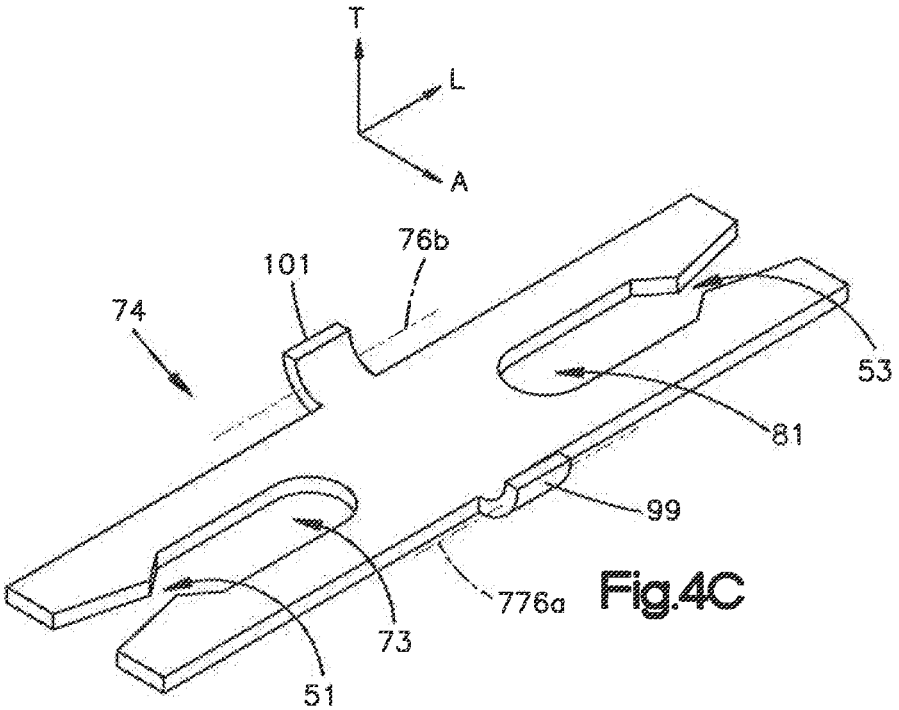
FIG. 4C is a perspective view of the sheet metal illustrated in FIG. 4B, but showing a first stage in forming of the insulation displacement contact illustrated in FIG. 4A.
Figure 4D:
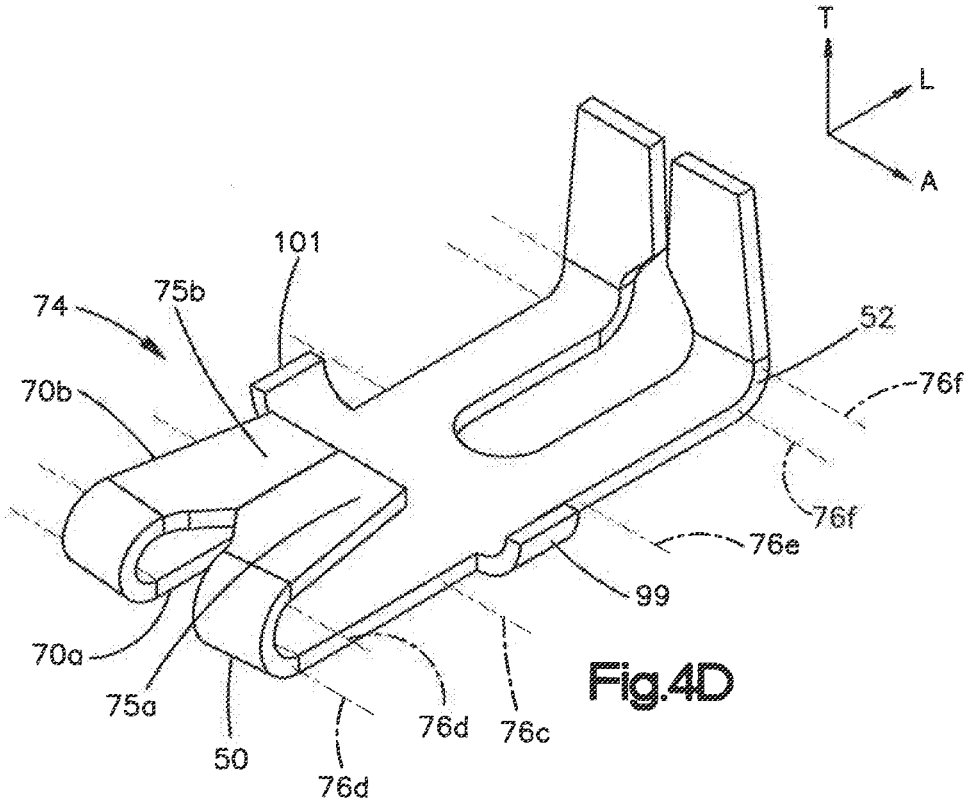
FIG. 4D is a perspective view of the sheet metal illustrated in FIG. 4C, but showing another stage in forming of the insulation displacement contact illustrated in FIG. 4A.

As illustrated in FIGS. 3A-3C, the entirety of the insulation displacement contact 22 can be made from a single monolithic blank sheet of stock material 74, such as a metal. For instance, a method of fabrication can include the step of stamping the sheet so as to define the first and second lead ins, the first and second strain relief apertures 73 and 81, and the first and second insulation displacement slots 51 and 53. The method of fabrication can further include the steps of bending the sheet along various bend lines to produce the mating and mounting portions 24 and 26. The sheet of stock material 74, and the stock material that comprises all insulation displacement contacts as described herein, can have any suitable dimension as desired. For instance, the stock material 74 and the stock material that comprises all insulation displacement contacts as described herein can have a thickness between 0.1 mm and 2 mm. For instance, the thickness can be approximately 0.3 mm. As will be described in more detail below, the sheet of stock material 74, and the stock material that comprises all insulation displacement contacts as described herein, can be bent along respective bend lines that are perpendicular to the thickness of the stock material so as to form the respective insulation displacement contact. It will be appreciated that the following bending steps can be performed in any order as desired.

The sheet of stock material 74 can be bent along first and second bend lines 76*a* and 76*b* that are parallel to each other and spaced from each other, so as to create the stand off members 103 and 105, and thus also the first and second stop members 99 and 101. In one example, the stock material 74 can be punched in the transverse direction T so as to define the first and second stop members 99 and 101 and the respective bend lines 76*a* and 76*b*. The first and second bend lines 76*a* and 76*b* can be spaced from each other along the longitudinal direction L, and can be oriented along the lateral direction A. The first bend line 76*a* can partially define both the first and second stop members 99 and 101. The second bend line 76*b* can also partially define both the first and second stop members 99 and 101. The stock material 74 can further be bent about a third bend line 76*c* so as to define the first arm 50. The third bend line 76*c* can be oriented along the lateral direction A and spaced from the stop members 99 and 101 along the longitudinal direction L. The stock material 74 can further be bent about at least one fourth bend line 76*d* so as to define the outer region 70*a* and the inner region 70*b* of the first arm 50. The at least one fourth bend line 76*d* can be configured as a pair of fourth bend lines 76*d* or a single bend line. The bend lines of the pair of fourth bend lines 76*d* can be oriented parallel to each other. The fourth bend lines 76*d* can be oriented along the lateral direction A, spaced from each other along the longitudinal direction L, and can be defined by the first arm 50. The stock material 74 can be bent in a first rotational direction about the respective third and fourth bend lines 76*c* and 76*d* so as to define the first arm 50, and the outer and inner regions 70*a* and 70*b*. The stock material 74 can further be bent about a fifth bend line 76*e* so as to define the second arm 52. The fifth bend line 76*e* can be oriented along the lateral direction A and spaced from the stop members 99 and 101 along the longitudinal direction L, such that the stop members 99 and 101 are disposed between the third and fifth bend lines 76*c* and 76*e* along the longitudinal direction L. The stop members can be equidistantly spaced from the third and fifth bend lines 76*c* and 76*e* along the longitudinal direction L. The stock material 74 can further be bent about at least one sixth bend line 76*f* so as to define the outer region 71*a* and the inner region 71*b*. The at least one sixth bend line 76*f* can be configured as a pair of bend lines or a single bend line. The at least one sixth bend line 76*f* can be configured as a pair of sixth bend lines 76*f*. The bend lines of the pair of sixth bend lines 76*f* can be oriented parallel to each other. The sixth bend lines 76*f* can be oriented along the lateral direction A, and can be defined by the second arm 52. The stock material 74 can be bent in a second rotational direction about the respective fifth and sixth bend lines 76*e* and 76*f* so as to define the second arm 52, and the outer and inner regions 71*a* and 71*b*. The second rotational direction can be opposite the first rotational direction. The first and second portions 75*a* and 75*b* of the inner region 70*b* of the first arm 50 can be bent toward each other so as to move the opposed surfaces of the first insulation displacement slot 51 toward each other, thereby defining the first insulation displacement slot 51. For instance, the opposed surfaces that define the first insulation displacement slot 51 can be brought into contact with each other. Alternatively, the first insulation displacement slot 51 can be defined by the stamping operation without bringing the opposed surfaces of the first insulation displacement slot 51 toward each other. Similarly, the first and second portions 95*a* and 95*b* of the inner region 71*b* of the second arm 52 can be bent toward each other so as to bring the opposed surfaces of the define the second insulation displacement slot 53, thereby defining the second insulation displacement slot 53. For instance, the opposed surfaces that define the second insulation displacement slot 53 can be brought into contact with each other. Alternatively, the second insulation displacement slot 53 can be defined by the stamping operation without bringing the opposed surfaces of the first insulation displacement slot 53 toward each other.

Referring now to FIGS. 1A-1D, the electrical connector assembly 20 can include one or more of the insulation displacement contacts 22 and a dielectric or electrically insulative connector housing 77 that is configured to support the one or more insulation displacement contacts 22. The connector housing 77 can be configured to retain a plurality of the insulation displacement contacts 22, and deliver the insulation displacement contacts 22 to the complementary electrical component 30. The connector housing 77 can further define an electrically insulative cover for the insulation displacement contacts 22 until such time as the electrical cables 28 are to be mated with the insulation displacement contacts 22. The connector housing 77 includes a dielectric or electrically insulative housing body 79 that defines an inner surface 79*a* and an outer surface 79*b* opposite the inner surface 79*a*. As will now be described, the insulation displacement contacts 22 are received in an interior of the connector housing 77 that is defined by the inner surface 79*a*. The housing body 79 includes an upper wall 85 and first and second outer walls 87*a* and 87*b* that extends down from the upper wall 85 along the transverse direction T. The first and second outer walls 87*a* and 87*b* are spaced from each other along the longitudinal direction L. The connector housing 77 is configured to receive the insulation displacement contacts such that the first and second arms 50 and 52 of the insulation displacement contact 22 are configured to be received between the first and second outer walls 87*a* and 87*b*. In particular, the inner surface 79*a* of the first and second outer walls 87*a* and 87*b* faces each of the insulation displacement contacts 22 when the insulation displacement contacts 22 are supported by the connector housing 77. The housing body 79 can further include a third wall 87*c* that extends down from the upper wall 85 at a location between the first and second outer walls 87*a* and 87*b*. Thus, the third wall 87*c* can be referred to as a middle wall. The third wall 87*c* can be equidistantly spaced between the first and second outer walls 87*a* and 87*b* along the longitudinal direction L.

The inner surface 79*a* of the housing body 79 at the upper wall 85, the first outer wall 87*a*, and the third wall 87*c* can combine to define a first inverted, or downward facing, concavity along the longitudinal direction L. The inner surface 79*a* of the housing body 79 at the upper wall 85, the second outer wall 87*b*, and the third wall 87*c* can combine to define a second inverted, or downward facing, concavity along the longitudinal direction L. The first, second, and third walls 87*a-c* and the upper wall 85 can all be monolithic with each other. For instance, the housing body 79 can be elongate along the lateral direction A. In accordance with one embodiment, the housing body 79 can be formed from extruded plastic or other suitable electrically insulative material. When the insulation displacement contact 22 is received by the connector housing 77, the first and second arms 50 and 52 are received by the first and second concavities, respectively. The third wall 87*c* is received between the inner regions 70*b* and 71*b* along the longitudinal direction L.

One or both of the connector housing 77 and the insulation displacement contacts 22 can include a respective engagement member that engages the other of the connector housing 77 and the insulation displacement contacts 22 when the insulation displacement contacts 22 are supported by the connector housing 77. For instance, engagement with the engagement member can assist in retention of the insulation displacement contacts 22 in the connector housing 77. For instance, the connector housing 77 can include at least one engagement member 91 that projects the out from the inner surface 79*a* and into a respective one of the concavities. For instance, the at least one engagement member 91 can project out from the inner surface 79*a* of the third wall 87*c*.

Thus, when the insulation displacement contacts 22 are supported by the connector housing 77, the projections defined by the engagement members 91 bear against the insulation displacement contacts 22, thereby retaining the insulation displacement contacts 22 in the connector housing 77. When the insulation displacement contacts 22 are supported in the connector housing 77, the first and second arms 50 and 52 of the insulation displacement contacts 22 are disposed between the first and second walls 87*a* and 87*b* of the connector housing 77 with respect to the longitudinal direction L. Further, when the insulation displacement contacts 22 are supported by the connector housing 77, the third wall 87*c* of the connector housing 77 is disposed between the first and second arms 50 and 52 of the insulation displacement contacts 22, and in particular is disposed between the first and second inner regions 70*b* and 71*b*. The insulation displacement contacts 22 can include respective engagement members that can be configured as recesses that are recessed into the contact body 23, and are sized so as to receive the projections 91 of the connector housing 77. The connector housing 77 can be elongate along the lateral direction A so as to receive a plurality of insulation displacement contacts 22 spaced from each other along the lateral direction A. The projections 91 can be elongate along the lateral direction A, or can be segmented into a respective plurality of projections 91 that are spaced from each other along the lateral direction A.

During operation, the insulation displacement contacts 22 are supported in the connector housing 77 in the manner described above. The insulation displacement contacts 22 supported by the connector housing 77 can be spaced from each other any distance along the lateral direction A as desired. The connector housing 77 can then be moved toward the underlying complementary electrical component 30 until the base 40, and in particular the outer contact surface 42, is placed adjacent the respective electrically conductive mounting pad of the complementary electrical component 30. A solder reflow can then attach the base 40 to the mounting pads of the complementary electrical component 30. An upward removal force can be applied to the connector housing 77 in the upward direction, which causes the connector housing 77 to be removed from the insulation displacement contacts 22.

The electrical cables 28 can then be inserted into the insulation displacement slots 51 and 53 and strain relief apertures 73 and 81 of respective ones of the insulation displacement contacts 22 so as to place the electrical cable 28 in electrical communication with the complementary electrical component 30. The first and second portions 75*a* and 75*b* of the first arm 50 can abut the first and second stop members 99 and 101 so as to limit movement of the first and second portions 75*a* and 75*b* away from each other in response to insertion of the electrical cable 28 in the first insulation displacement slot 51. Similarly, the first and second portions 95*a* and 95*b* of the second arm 52 can abut the first and second stop members 99 and 101 so as to limit movement of the first and second portions 95*a* and 95*b* away from each other in response to insertion of the electrical cable 28 in the second insulation displacement slot 53. The method of placing the electrical cable 28 in electrical communication with the complementary electrical component 30 can include the steps of placing the mounting portion 26 of the insulation displacement contact 22 in electrical communication with the complementary electrical component 30. The method can include the step of applying electrical current between the electrical cable 28 and the complementary electrical component 30. A method can further be provided for selling the one or more insulative displacement contacts 22 or the electrical connector assembly 20. The method can include the steps of teaching to a third party one or more up to all of the method steps described herein, and selling to the third party the insulative displacement contact 22 or the electrical connector assembly 20.

Further, a method can be provided for selling one or more of the insulation displacement contacts 22, the electrical connector assembly 20, the method including the steps of teaching to a third party one or more method steps of using or assembling one or more of the insulation displacement contacts 22 and the electrical connector assembly 20, and selling to the third party at least one or more of the insulation displacement contacts 22 and the electrical connector assembly 20, either with the insulation displacement contacts 22 supported by the connector housing 77 or separate from the connector housing 77.

It should be appreciated that the insulation displacement contacts 22 can be constructed in accordance with any suitable alternative embodiment as desired. For instance, the first and second stop members 99 and 101 can be constructed in accordance with any suitable alternative embodiment so long as they are configured to abut the inner regions 70*b* and 71*b* of the first and second arms 50 and 52 as the respective first and second portions 75*a* and 75*b*, and 95*a* and 95*b*, move away from each other along the lateral direction A. For instance, referring to FIGS. 4A-4D, the first and second stop members 99 and 101 can have a thickness in the lateral direction A that is equal to the thickness of the stock material that defines the insulation displacement contact 22. Further, the base 40 can include stand off members 103 and 105 that extends up from the inner surface 44 along the transverse direction T to the first and second stop members 99 and 101, respectively. The stop members 99 and 101 can each define a first end that extends out from the stand off members 103 and 105, respectively. The stop members 99 and 101 can each define a second free end that is opposite the first end. For instance, the second free end can be offset from the first end along the transverse direction T. Thus, it can be said that the first end of each of the stop members 99 and 101 is attached to the base 40 and the second end of each of the stop members 99 and 101 is a free end.

It should be appreciated that the stop members 99 and 101 can be rigidly attached to the base 40. Accordingly, the first portions 75*a* and 95*a* of the inner regions 70*b* and 71*b*, respectively, are unable to move away from each other in the lateral direction A after abutting the respective stop members 99 and 101. Alternatively, the stop members can be resiliently flexible. Accordingly, the first portions 75*a* and 95*a* of the inner regions 70*b* and 71*b*, respectively, are able to move away from each other in the lateral direction A after abutting the respective stop members 99 and 101, against the spring force of the stop members 99 and 101. The insulation displacement contact 22 defines a plane that 1) is defined by the longitudinal direction L and the lateral direction A, and 2) intersects each of the first portions 75*a* and 95*a* along the lateral direction A.

With continuing reference to FIGS. 4A-4D, the entirety of the insulation displacement contact 22 can be made from a single monolithic blank sheet of stock material 74, such as a metal. For instance, a method of fabrication can include the step of stamping the sheet so as to define the first and second lead ins, the first and second strain relief apertures 73 and 81, the first and second insulation displacement slots 51 and 53, and first and second tabs that define the first and second stop members 99 and 101, respectively. The method of fabrication can further include the steps of bending the sheet along various bend lines to produce the mating and mounting portions 24 and 26. The sheet of stock material 74, and the stock material that comprises all insulation displacement contacts as described herein, can have any suitable dimension as desired. For instance, the stock material 74 and the stock material that comprises ail insulation displacement contacts as described herein can have a thickness between 0.1 mm and 2 mm. For instance, the thickness can be approximately 0.3 mm. As will be described in more detail below, the sheet of stock material 74, and the stock material that comprises all insulation displacement contacts as described herein, can be bent along respective bend lines that are perpendicular to the thickness of the stock material so as to form the respective insulation displacement contact. It will be appreciated that the following bending steps can be performed in any order as desired.

The sheet of stock material 74 can be bent along first and second bend lines 76*a* and 76*b* that are parallel to each other and spaced from each other, so as to create the stand off members 103 and 105, and thus also the first and second stop members 99 and 101. The first bend line 76*a* can define the first stop member 99, and the second bend line 76*b* can define the second stop member 101. The first and second bend lines 76*a* and 76*b* can be spaced from each other along the lateral direction A, and can be oriented along the longitudinal direction L. The stock material 74 can further be bent about a third bend line 76*c* so as to define the first arm 50. The third bend line 76*c* can be oriented along the lateral direction A and spaced from the stop members 99 and 101 along the longitudinal direction L. The stock material 74 can further be bent about at least one fourth bend line 76*d* so as to define the outer region 70*a* and the inner region 70*b* of the first arm 50. The at least one fourth bend line 76*d* can be configured as a pair or fourth bend lines 76*d* or a single bend line. The bend lines of the pair of fourth bend lines 76*d* can be oriented parallel to each other. The fourth bend lines 76*d* can be oriented along the lateral direction A, and can be defined by the first arm 50. The stock material 74 can be bent in a first rotational direction about the respective third and fourth bend lines 76*c* and 76*d* so as to define the first arm 50, and the outer and inner regions 70*a* and 70*b*. The stock material 74 can further be bent about a fifth bend line 76*e* so as to define the second arm 52. The fifth bend line 76*e* can be oriented along the lateral direction A and spaced from the stop members 99 and 101 along the longitudinal direction L, such that the stop members 99 and 101 are disposed between the third and fifth bend lines 76*c* and 76*e* along the longitudinal direction L. The stop members can be equidistantly spaced from the third and fifth bend lines 76*c* and 76*e* along the longitudinal direction L. The stock material 74 can further be bent about at least one sixth bend line 76*f* so as to define the outer region 71*a* and the inner region 71*b*. The at least one sixth bend line 76*f* can be configured as a pair of bend lines or a single bend line. The at least one sixth bend line 76*f* can be configured as a pair of sixth bend lines 76*f*. The bend lines of the pair of sixth bend lines 76*f* can be oriented parallel to each other. The sixth bend lines 76*f* can be oriented along the lateral direction A, and can be defined by the second arm 52. The stock material 74 can be bent in a second rotational direction about the respective fifth and sixth bend lines 76*e* and 76*f* so as to define the second arm 52, and the outer and inner regions 71*a* and 71*b*. The second rotational direction can be opposite the first rotational direction. The first and second portions 75*a* and 75*b* of the inner region 70*b* of the first arm 50 can be bent toward each other so as to define the first insulation displacement slot 51. Alternatively, the first insulation displacement slot 51 can be defined by the stamping operation without bending the first and second portions 75*a* and 75*b* of the inner region 70*b* of the first arm 50 toward each other. Similarly, the first and second portions 95*a* and 95*b* of the inner region 71*b* of the second arm 52 can be bent toward each other so as to define the second insulation displacement slot 53. Alternatively, the second insulation displacement slot 53 can be defined by the stamping operation without bending the first and second portions 95*a* and 95*b* of the inner region 71*b* of the second arm 52 toward each other.

With continuing reference to FIGS. 4A-4D, the abutment surfaces of the stop members 99 and 101 can extend in the longitudinal direction L a sufficient length so as to define first and second locations that are aligned with each of the first and second portions 75*a* and 95*a* along the lateral direction A. The first and second locations can be defined by the same abutment surface. Thus, a first line oriented along the lateral direction A can pass through the first location of the first stop member 99, the first location of the second stop member 99, and the first portion 75*a*. Similarly, a second line oriented along the lateral direction A can pass through the second location of the first stop member 99, the second location of the second stop member 99, and the first portion 95*a*. Further, the first stop member 99 can include a first continuous line that extends from the first location of the first stop member 99 to the second location of the first stop member 99, wherein the continuous line lies in the plane. Similarly, the second stop member 101 can include a second continuous line that extends from the first location of the second stop member 101 to the second location of the second stop member 101, wherein the continuous line lies in the plane.

Figure 5A:
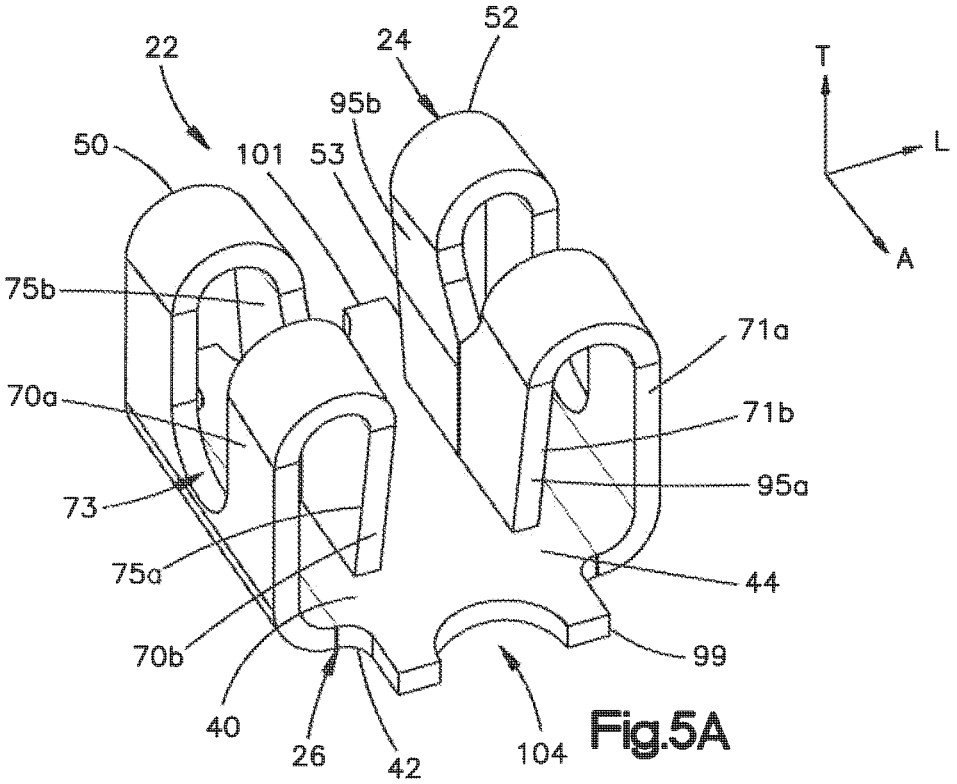
FIG. 5A is a perspective view of an insulation displacement contact constructed in accordance with an alternative embodiment.
Figure 5B:
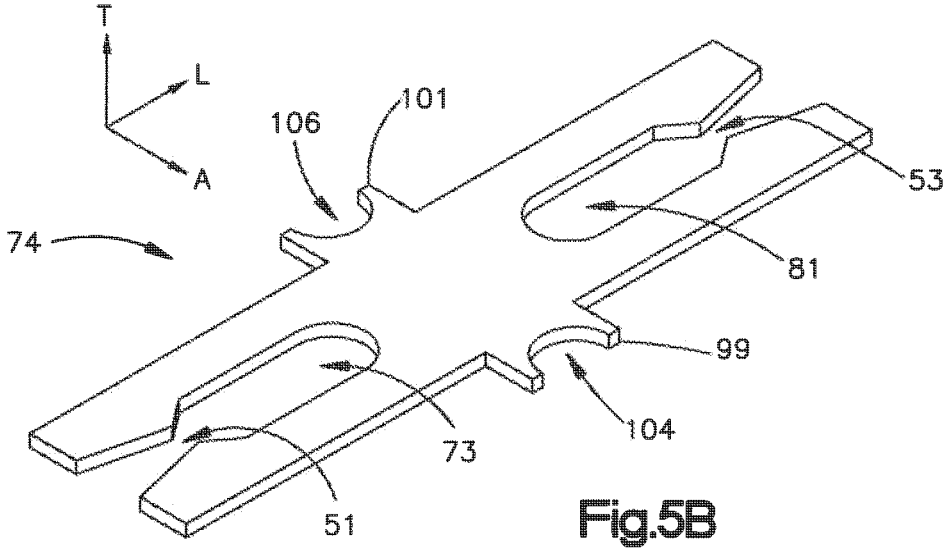
FIG. 5B is a perspective view of a blank of sheet metal configured to be bent so as to fabricate the insulation displacement contact illustrated in FIG. 5A.

Alternatively, referring now to FIGS. 5A-5B, the first stop member 99 can define a first gap 104 that extends along the longitudinal direction L between the first and second locations of the first stop member 99. For instance, the first stop member 99 can define a first recess 106 that is disposed between the first and second locations. The recess 106 can be any shape as desired, such as arc-shaped. Thus, the first and second locations of the first stop member 99 can be discrete from each other with respect to the longitudinal direction L. The first and second locations of the first stop member 99 can be defined by respective first and second abutment surfaces of the first stop member 99. Similarly, the second stop member 101 can define a second gap 108 that extends along the longitudinal direction L between the first and second locations of the second stop member 101. For instance, the second stop member 101 can define a second recess 110 that is disposed between the first and second locations. The recess 110 can be any shape as desired, such as arc-shaped. Thus, the first and second locations of the second stop member 101 can be discrete from each other with respect to the longitudinal direction L. It should be appreciated that the first and second stop members 99 and 101 are oriented as illustrated above in FIG. 4A during operation, but are illustrated as flat to show fabrication of the insulation displacement contact 22. The first and second locations of the second stop member 101 can be defined by respective first and second abutment surfaces of the second stop member 101.

With continuing reference to FIGS. 5A-5B, the entirety of the insulation displacement contact 22 can be made from a single monolithic blank sheet of stock material 74, such as a metal. For instance, a method of fabrication can include the steps described above with respect to FIGS. 4A-4D. The method to create the insulation displacement contact 22 of FIGS. 5A-5B differs from the method described with respect to FIGS. 4A-4D only insofar as the step of stamping the sheet to define the first and second stop members 99 and 101 further includes creating the first and second gaps 104 and 106.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Thus, each insulation displacement contact can include one or more up to all features, including structure and methods, alone or in combination, as the other insulation displacement contacts as described herein. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An insulation displacement contact configured to receive an electrical cable, the insulation displacement contact comprising:

a base configured to be mounted onto a substrate so as to place the insulation displacement contact in electrical communication with the substrate; and a first arm comprising a first segment that extends out with respect to the base, the first arm comprising a second segment including first and second opposed portions that face each other so as to define a first insulation displacement slot therebetween, wherein the second segment extends toward the base, and the first and second opposed portions are configured to move away from each other in response to insertion of the electrical cable in the first insulation displacement slot; and at least one stop member spaced from the first arm, the at least one stop member configured to abut one of the first and second opposed portions when the first and second opposed portions move away from each other in response to insertion of the electrical cable in the first insulation displacement slot, wherein the first insulation displacement slot is configured to receive the electrical cable such that first and second piercing members that at least partially define the first insulation displacement slot pierces an outer electrically insulative layer of the electrical cable and contacts an electrical conductor of the electrical cable that is disposed inside the electrically insulative layer.

2. The insulation displacement contact as recited in claim 1, wherein the at least one stop member comprises a first stop member that is aligned with the first portion of the first arm, and the insulation displacement contact further comprises a second stop member that is aligned with the second portion of the first arm, wherein the first and second stop members are configured to abut the first and second portions of the first arm, respectively, when the first and second portions move away from each other in response to insertion of the electrical cable in the first insulation displacement slot.

3. The insulation displacement contact as recited in claim 1, further comprising a second arm that extends out with respect to the base, the second arm defining a second insulation displacement slot, wherein the second arm comprises first and second portions that face each other so as to define the second insulation displacement slot, and the first and second portions are aligned with the first and second stop members, respectively, such that the first and second portions of the second arm contact the first and second stop members, respectively, when the first and second portions of the second arm move away from each other in response to insertion of the electrical cable in the second insulation displacement slot, wherein the first and second insulation displacement slots are aligned with each other along a longitudinal direction so that when an electrical cable extends through the first and second insulation displacement slots along the longitudinal direction, respective first and second piercing members that at least partially define respective ones of the first and second insulation displacement slots pierce an outer electrically insulative layer of the electrical cable and contact an electrical conductor of the electrical cable that is disposed inside the electrically insulative layer.

4. The insulation displacement contact as recited in claim 3, wherein the first and second arms extend up from the base, and the first and second stop members are disposed above the base.

5. The insulation displacement contact as recited in claim 3, wherein the first and second portions of each of the first and second arms are adjacent each other along a lateral direction, and the first stop member is aligned with the first portions of each of the first and second arms along the lateral direction, such that the first portions of each of the first and second arms are disposed between the first stop member and the second portions of each of the first and second arms, respectively, along the lateral direction.

6. The insulation displacement contact as recited in claim 5, wherein the second stop member is aligned with the second portions of each of the first and second arms along the lateral direction, such that the second portions of each of the first and second arms are disposed between the second stop member and the first portions of each of the first and second arms, respectively, along the lateral direction.

7. The insulation displacement contact as recited in claim 3, wherein the first and second stop members are rigidly attached to the base.

8. The insulation displacement contact as recited in claim 3, wherein the first and second stop members are flexibly attached to the base.

9. The insulation displacement contact as recited in claim 3, wherein the first and second stop members are each attached to the base at opposed ends.

10. The insulation displacement contact as recited in claim 9, wherein the opposed ends are spaced from each other along the longitudinal direction.

11. The insulation displacement contact as recited in claim 3, wherein the first and second stop members are each attached to the base at a first end, and free from the base at a second end that is opposite the first end.

12. The insulation displacement contact as recited in claim 11, wherein the second end is offset from the first end along a transverse direction that is perpendicular to the lateral direction and perpendicular to the base.

13. The insulation displacement contact as recited in claim 3, further comprising a first strain relief aperture that extends through the first arm, the first strain relief aperture aligned with the first insulation displacement slot along the longitudinal direction, wherein opposed surface portions that define the strain relief aperture are configured to constrain the outer electrically insulative layer when the electrical cable extends through the first strain relief aperture.

14. The insulation displacement contact as recited in claim 13, wherein the opposed surface portions that define the strain relief aperture are configured to constrain the electrically insulative layer without extending through the outer electrically insulative layer to the electrical conductor when the electrical cable extends through the first strain relief aperture.

15. The insulation displacement contact as recited in claim 13, wherein the first arm includes an inner region that defines the first insulation displacement slot, and an outer region that defines the strain relief aperture.

16. The insulation displacement contact as recited in claim 13, wherein the first insulation displacement slot defines a first width, and the first strain relief aperture defines a second width that is greater than the first width.

17. The insulation displacement contact as recited in claim 3, wherein each of the first and second insulation displacement slots is defined by opposed surfaces that are spaced from each other by a distance prior to insertion of the electrical cable in the first and second insulation displacement slots.

18. The insulation displacement contact as recited in claim 3, wherein each of the first and second insulation displacement slots is defined by opposed surfaces that abut each other prior to insertion of the electrical cable in the first and second insulation displacement slots.

19. The insulation displacement contact as recited in claim 1, wherein an entirety of the insulation displacement contact comprises a single monolithic structure.

20. An electrical connector assembly comprising:

at least one insulation displacement contact as recited in claim 1; and an electrically insulative connector housing including a housing body that includes an upper wall, and first and second walls that extend down from the upper wall, wherein the connector housing is configured to support the at least one insulation displacement contact such that the first and second arms of the insulation displacement contact are disposed between the first and second walls of the connector housing.

21. The electrical connector assembly as recited in claim 20, wherein the housing body further comprises a third wall that extends down from the upper wall at a location between the first and second wall of the connector housing.

22. The electrical connector assembly as recited in claim 21, wherein when the at least one insulation displacement contact is supported by the connector housing, the first arm of the insulation displacement contact is disposed between the first and third walls of the connector housing, and the second arm of the insulation displacement contact is disposed between the second and third walls of the connector housing.

23. The electrical connector assembly as recited in claim 20, wherein the base is disposed below the first and second walls of the connector housing when the at least one electrical contact is supported by the connector housing.

24. The electrical connector assembly as recited in claim 21, wherein the connector housing comprises at least one engagement member that extends out from the third wall so as to contact the insulation displacement contact that is supported by the connector housing.

25. A method of placing an electrical cable in electrical communication with a substrate, the method comprising the steps of:

inserting the electrical cable into a first insulation displacement slot and a first strain relief aperture of an insulation displacement contact, the insulation displacement contact comprising:

a base configured to be mounted onto the substrate so as to place the insulation displacement contact in electrical communication with the substrate, a first arm that extends out with respect to the base, the first arm including first and second opposed portions that face each other so as to define the first insulation displacement slot therebetween, wherein the first strain relief aperture extends through the first arm, and at least one stop member spaced from the first arm;

during the inserting step, causing the first and second portions of the first arm to move away from each other;

after the causing step, bringing the first and second portions of the first arm against the at least one stop member.

26. The method as recited in claim 25, further comprising the step of placing the base of the insulation displacement contact on the substrate, so as to establish electrical communication between the electrical cable and the substrate after the placing and inserting steps.

27. An insulation displacement contact configured to receive an electrical cable, the insulation displacement contact comprising:

a base configured to be mounted onto a substrate so as to place the insulation displacement contact in electrical communication with the substrate; and a first arm having an outer region that extends out with respect to the base, and an inner region that extends from the outer region toward the base, wherein the inner region includes first and second portions that define a first insulation displacement contact there between, the outer region defines a strain relief aperture that extends therethrough, and the first insulation displacement slot is configured to receive the electrical cable such that first and second piercing members that at least partially define the first insulation displacement slot is configured to pierce an outer electrically insulative layer of the electrical cable and contact an electrical conductor of the electrical cable that is disposed inside the electrically insulative layer; and a second arm having an outer region that extends out with respect to the base, and an inner region that extends from the outer region toward the base such that the inner regions are disposed between the outer regions with respect to a longitudinal direction, wherein the inner region of the second arm includes first and second portions that define a second insulation displacement contact therebetween, the outer region of the second arm defines a strain relief aperture that extends therethrough, and the second insulation displacement slot is configured to receive the electrical cable such that first and second piercing members that at least partially define the first insulation displacement slot is configured to pierce the outer electrically insulative layer and contact the electrical conductor.

28. The insulation displacement contact as recited in claim 27, further comprising a first stop member spaced from the first portion of the first arm along a lateral direction that is perpendicular to the longitudinal direction, wherein the first and second portions of the first arm are configured to move away from each other along the lateral direction in response to insertion of the electrical cable into the first insulation displacement slot, and the at least one stop member is aligned with the first portion of the first arm so as to abut the first portion of the first arm when the first portion of the first arm moves away from the second portion of the first arm in response to insertion of the electrical cable in the first insulation displacement slot.

29. The insulation displacement contact as recited in claim 28, wherein the first stop member is further spaced from the first portion of the second arm along the lateral direction, and the first stop member is further aligned with the first portion of the second arm so as to abut the first portion of the second arm when the first portion of the second arm moves away from the second portion of the second arm in response to insertion of the electrical cable in the second insulation displacement slot.

30. The insulation displacement contact as recited in claim 27, wherein the inner region of the first arm is disposed between the outer region of the first arm and the inner region of the second arm.

31. A method of fabricating an insulation displacement contact, the method comprising the steps of:

stamping a sheet of metallic stock material;

bending the sheet along a first bend line so as to define a base of the insulation displacement contact;

bending the sheet to form a stop member that extends up from the base;

bending the sheet along a second bend line so as to define an arm that extends from the base; and bending the sheet along a third pair of bend lines so as to define inner and outer regions of the arm, wherein the inner region is aligned with the stop member along a lateral direction and extends toward the base, and the inner region includes first and second portions that are adjacent each other along the lateral direction and face each other so as to define an insulation displacement slot, such that the first and second portions are torsionally movable away from each other in response to insertion of an electrical cable into the insulation displacement slot.

32. The method as recited in claim 31, wherein the third bending step comprises defining a strain relief aperture that extends through the outer region.

33. The method as recited in claim 31, further comprising the step of bringing first and second portions of the inner region toward each other after the third bending step, wherein the first and second portions face each other so as to define the insulation displacement slot.

34. The method as recited in claim 31, wherein the stamping step defines the insulation displacement slot without bringing the first and second portions of the inner region toward each other.

35. The method as recited in claim 32, further comprising the step of bending the sheet along a fourth bend line so as to define a second arm, and bending the sheet along a fifth bend line so as to define inner and outer regions of the second arm, wherein the inner region includes first and second portions that define a second insulation displacement slot, and the outer region defines a second strain relief slot.

36. The method as recited in claim 31, wherein the first bending step comprises bending the sheet along the first bend line so as to define the stop member that is attached to the base at a first end, and defines a second end opposite the first end, the second end being a free end.

37. A method of fabricating an insulation displacement contact, the method comprising the steps of:

stamping a sheet of metallic stock material;

bending the sheet along a first bend line so as to define a base of the insulation displacement contact;

bending the sheet for form a stop member that extends up from the base;

bending the sheet along a second bend line so as to define an arm that extends from the base; and bending the sheet along a third pair of bend lines so as to define inner and outer regions of the arm, wherein the inner region is aligned with the stop member along a lateral direction, and the inner region includes first and second portions that are adjacent each other along the lateral direction and face each other so as to define an insulation displacement slot, such that the first and second portions are torsionally movable away from each other in response to insertion of an electrical cable into the insulation displacement slot, wherein the first bending step comprises punching the sheet so as to create the first stop member that is attached to the base at opposed ends thereof.

* * * * *